US010738413B2

(12) United States Patent
Durham

(10) Patent No.: US 10,738,413 B2
(45) Date of Patent: Aug. 11, 2020

(54) GARMENT DRYERS AND COMPONENTS FOR USE WITHIN GARMENT DRYERS

(71) Applicant: Daniel Durham, Fremont, MI (US)

(72) Inventor: Daniel Durham, Fremont, MI (US)

( * ) Notice: Subject to any disclaimer, the term of this patent is extended or adjusted under 35 U.S.C. 154(b) by 106 days.

(21) Appl. No.: 15/987,822

(22) Filed: May 23, 2018

(65) Prior Publication Data

US 2018/0266044 A1 Sep. 20, 2018

Related U.S. Application Data

(63) Continuation-in-part of application No. 13/788,116, filed on Mar. 7, 2013, now Pat. No. 10,295,258, and a continuation-in-part of application No. 15/336,730, filed on Oct. 27, 2016, now Pat. No. 10,323,882.

(60) Provisional application No. 62/514,792, filed on Jun. 3, 2017, provisional application No. 62/550,600, filed on Aug. 26, 2017.

(51) Int. Cl.

| | |
|---|---|
| ***F26B 3/00*** | (2006.01) |
| ***D06F 59/04*** | (2006.01) |
| *D06F 58/10* | (2006.01) |
| *D06F 59/02* | (2006.01) |

(52) U.S. Cl.

CPC ..... *D06F 59/04* (2013.01); *D06F 58/10* (2013.01); *D06F 59/02* (2013.01)

(58) Field of Classification Search

CPC ..... D06F 59/04; D06F 59/02; D06F 58/10
USPC ..... 34/493, 415, 443, 467, 509, 549, 553
See application file for complete search history.

(56) References Cited

U.S. PATENT DOCUMENTS

| | | | | |
|---|---|---|---|---|
| 5,604,993 | A * | 2/1997 | Auckerman | D06F 59/04 219/211 |
| 5,657,897 | A * | 8/1997 | Schwartzburg | B65D 1/265 220/669 |
| 6,085,436 | A * | 7/2000 | Peet | D06F 59/04 223/78 |
| 2001/0049883 | A1* | 12/2001 | Ryden | D06F 59/02 34/104 |
| 2014/0075776 | A1* | 3/2014 | Potter | F26B 9/02 34/493 |
| 2016/0161183 | A1* | 6/2016 | Barnes | F26B 21/006 34/104 |
| 2016/0316883 | A1* | 11/2016 | Guerra | A45D 20/12 |
| 2017/0119145 | A1* | 5/2017 | Munoz | A46B 17/065 |

* cited by examiner

*Primary Examiner* — John P McCormack
(74) *Attorney, Agent, or Firm* — James E. Shultz Jr.

(57) ABSTRACT

A glove dryer may include a vehicle mounting arrangement (e.g., a cup holder insert or a docking station) such that the glove dryer may be maintained in an upright orientation while the vehicle is accelerating, turning, traveling over bumps, decelerating, etc. A glove dryer may include an automatic controller.

20 Claims, 21 Drawing Sheets

GARMENT DRYERS AND COMPONENTS FOR USE WITHIN GARMENT DRYERS

CROSS-REFERENCE TO RELATED APPLICATION AND CLAIM TO PRIORITY

The present application claims priority under 35 U.S.C. § 119(e) of U.S. Provisional Application Ser. No. 62/514,792, entitled GLOVE DRYER AND COMPONENTS FOR USE WITH A GLOVE DRYER, filed Jun. 3, 2017; and 62/550,600, entitled GLOVE DRYER AND COMPONENTS FOR USE WITH A GLOVE DRYER, filed Aug. 26, 2017; the entire disclosures of which are incorporated herein by reference.

This application is a continuation-in-part of U.S. patent application Ser. No. 13/788,116, filed Mar. 7, 2013, which is a continuation of U.S. Pat. No. 8,393,482; and U.S. patent application Ser. No. 15/336,730, entitled SPORTS EQUIPMENT RACK WITH ODOR MITIGATING ENCLOSURE, filed Oct. 27, 2016, the entire disclosures of which are incorporated in their entireties by referenced herein.

TECHNICAL FIELD

The present disclosure generally relates to drying and drying apparatuses for gloves and mittens. More particularly, the present disclosure relates to portable glove drying apparatuses for use in moving vehicles.

BACKGROUND

Many individuals have outdoor occupations and/or hobbies and find themselves needful of a device that will dry and/or warm gloves. Often times, an individual may be traveling in a vehicle between sites.

It is an objective of the present invention to provide a glove drying for use in moving vehicles. It is a further objective to provide such a device that may also be provided in combination with a drying apparatus. A still further object is to provide such a device with provisions to direct drying air into a glove including the finger portions thereof, and to circulate and subsequently discharge the drying air to the atmosphere. A yet further object is to provide such a device that will readily accept gloves, and that will permit easy removal of such gloves from the dryer. These and still further objects and advantages will become apparent from the following description of preferred embodiments.

SUMMARY

A glove dryer may include a vehicle mounting structure and an internal battery. The vehicle mounting structure may insure that the glove dryer remains in an upright orientation while the vehicle accelerates, turns, travels over bumps, decelerates, etc.

In another embodiment, a glove dryer may include an internal battery and a control circuit operable to continuously variably regulate operation of an electric heater element within a continuous range of heat intensities and an electric blower within a continuous range of air flow speeds to produce any desired heated air flow output having a heat intensity and air flow speed within such continuous ranges.

In a further embodiment, a glove dryer may include an internal battery and a control circuit operable to automatically regulate an electric heater element and/or an electric blower to dry a glove to a predetermined moisture and/or warm a glove to a predetermined temperature.

A glove dryer may include a body having a substantially round shaped base. The substantially round shaped base may be configured to be received within a standard vehicle cup holder. The glove dryer may also include at least one glove air exhaust tube that may be rotatable with respect to the body.

In another embodiment, a glove dryer may include a body having a substantially round shaped base. The substantially round shaped base may be configured to be received within a base of a docking station. The glove dryer may also include at least one, glove air exhaust tube. The glove air exhaust tube may be slidingly removable.

In a further embodiment, a glove dryer may include a body having a substantially round shaped base. The substantially round shaped base may be configured to be received within a vehicle mounting apparatus. The vehicle mounting apparatus may be selected from the group including at least one of: a vehicle cup holder, or a docking station. The glove dryer may also include at least one air exhaust tube. The at least one air exhaust tube may be selected from the group including at least one of: a glove air exhaust tube, a space heater exhaust tube, a hat air exhaust tube, a helmet air exhaust tube, a windshield defroster air exhaust tube, or a hand warmer air exhaust tube.

A glove dryer may include a vehicle mounting structure. The vehicle mounting structure may insure that the glove dryer remains in an upright orientation while the vehicle accelerates, turns, travels over bumps, decelerates, etc.

In another embodiment, a glove dryer may include a control circuit operable to continuously variably regulate operation of an electric heater element within a continuous range of heat intensities and an electric blower within a continuous range of air flow speeds to produce any desired heated air flow output having a heat intensity and air flow speed within such continuous ranges.

In a further embodiment, a glove dryer may include a control circuit operable to automatically regulate an electric heater element and/or an electric blower to dry a glove to a predetermined moisture and/or warm a glove to a predetermined temperature.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

Various embodiments of the invention are described below with reference to the following accompanying drawings. These embodiments are intended for illustrative purposes and shall not be construed as limiting in anyway.

DETAILED DESCRIPTION

Glove dryers and components for use in glove dryers are provided for use within moving vehicles. The glove dryers may be securely inserted into a vehicle cup holder and/or inserted into an accompanying docking station. It is pointed out that a glove dryer of the present disclosure may be produced and sold as complete, dedicated glove dryer apparatus, without departing from the scope of the present invention. Further, a glove dryer of the present disclosure may be produced separately from an associated docking station, and be sold separately for later mounting to appropriate dryer units for utility as a glove dryer.

A glove dryer may be constructed of conventional plastics, by conventional plastic forming techniques such as injection molding. While these standard materials and production techniques are preferred, other materials may be used, along with other conventional forming techniques.

Figure 1:
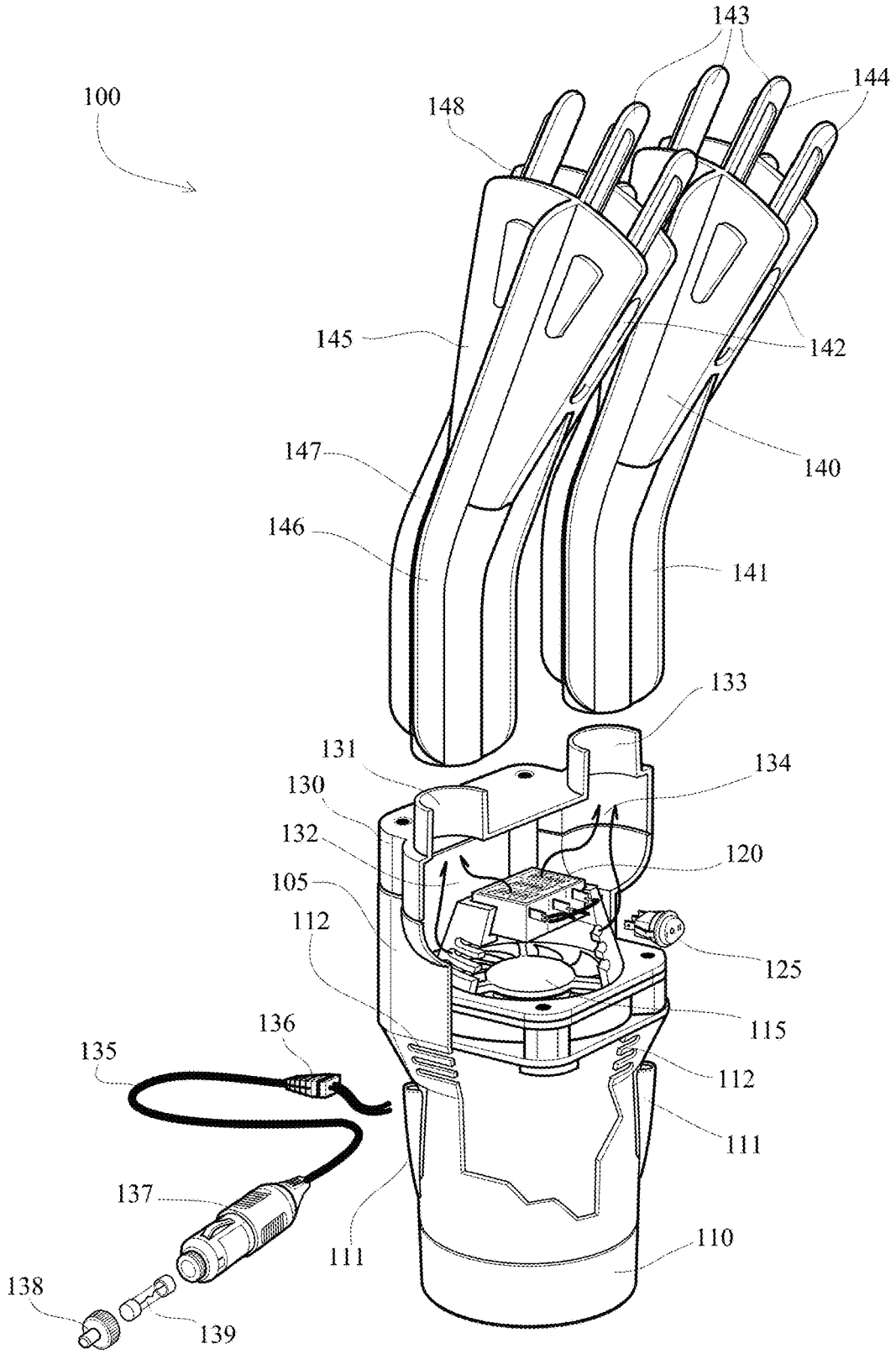
FIG. 1 depicts an example glove dryer having a partially cut away housing to illustrate internal components.
Figure 7:
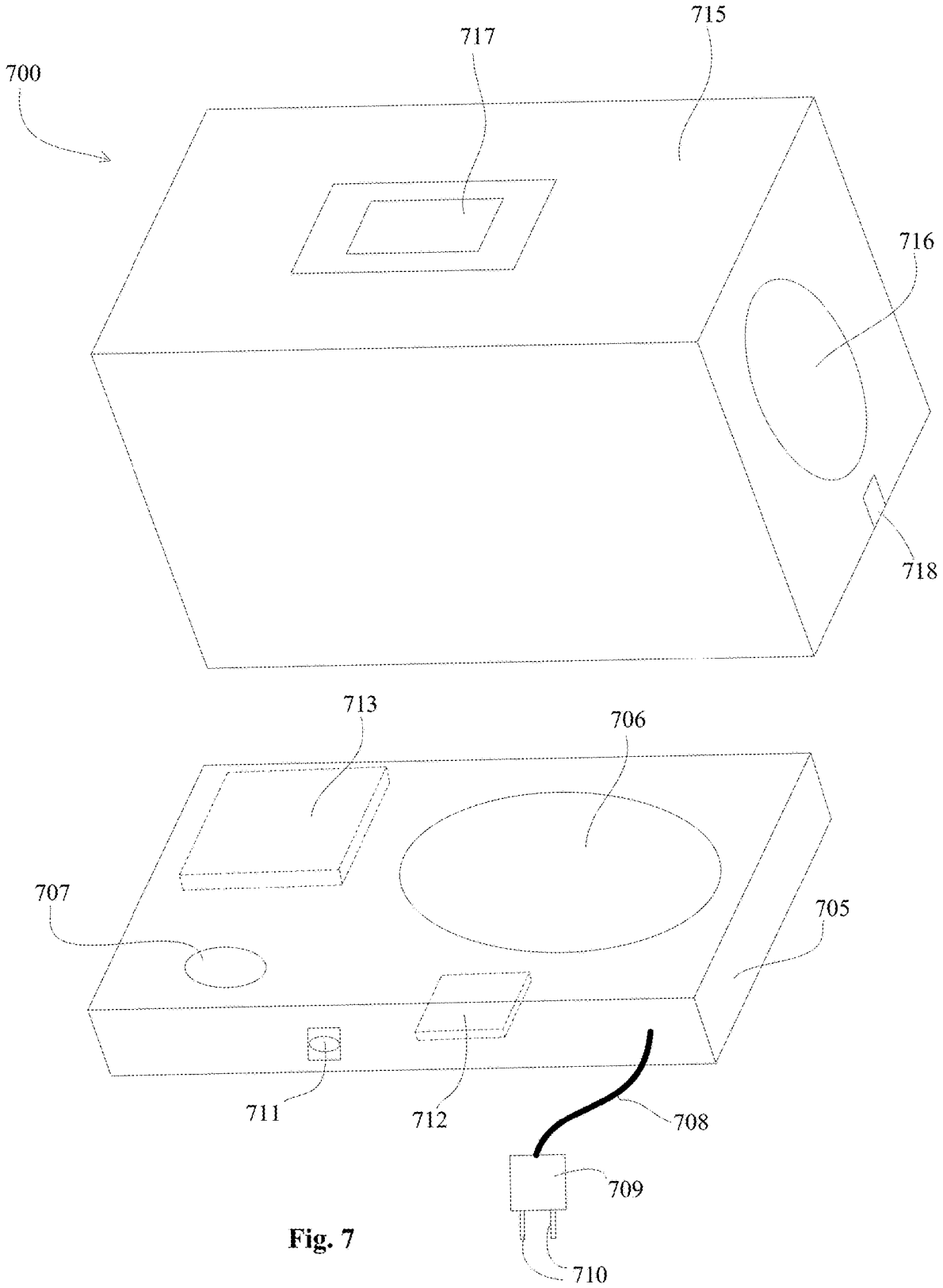
FIG. 7 depicts an example docking station and carrying case for a glove dryer of FIG. 1, 2A or 2B.

Turning to FIG. 1, a glove dryer 100 may include a substantially square body 105 having a substantially round base 110 with tension tabs 111 configured to be received within a standard vehicle cup holder (not shown in FIG. 1) and/or within a receptacle of an associated docking station (e.g., receptacle 706 of the docking station 700 of FIG. 7). Thereby, the glove dryer 100 may be maintained in an upright orientation even when an associated vehicle is accelerating, turning, traveling over bumps, decelerating, etc. The substantially square body 105 may further include air intake vents 112 for air intake to an electric blower (or fan) 115. The substantially square body 105 may be configured to receive the electric blower (or fan) 115, an electric heater element 120 and an associated user control 125 (e.g., an on/off switch). As can be seen in FIG. 1, a portion of the substantially square body 105 is cut away such that the electric blower (or fan) 115 and the electric heater element 120 are visible. In any event, the electric blower (or fan) 115 and the electric heater element 120 may be secured in position within the substantially square body 105 via a cover 130. The cover 130 may include a first air exhaust 131 for air flow 132 from the electric blower (or fan) 115 and a second air exhaust 133 for air flow 134 from the electric blower (or fan) 115.

The glove dryer 100 may also include an electric supply cable 135, an electric supply cable adapter 136, a cigarette lighter plug 137, 138, and a fuse 139. The electric supply cable adapter 136 may be configured to receive other electric supply cables other than that shown in FIG. 1.

The glove dryer 100 may include a first glove air exhaust tube 140 and a second glove air exhaust tube 145. The first and second glove air exhaust tubes 140, 145 may be configured to sliding engage a respective one of the first and second air exhausts 131, 133. The first and second glove air exhaust tubes 140, 145 may include finger shaped supports 143 with finger ribs 144 configured to direct air flow from the electric blower (or fan) 115 into each respective finger of a corresponding glove (e.g., finger 372, 373, 374 of FIG. 3). The first and second glove air exhaust tubes 140, 145 may include a thumb air outlet deflector 142 configured to direct air flow from the electric blower (or fan) 115 into a respective thumb of a corresponding glove (e.g., thumb 375 of FIG. 3). The first and second glove air exhaust tubes 140, 145 may include a pinky finger air outlet deflector 148 configured to direct air flow from the electric blower (or fan) 115 into a respective pinky finger of a corresponding glove (e.g., pinky finger 371 of FIG. 3). The first and second glove air exhaust tubes 140, 145 may include wrist ribs 141, 146, 147 configured to direct air flow out of the pinky finger 371, a finger 372, 373, 374, and a thumb 375. While the first and second glove air exhaust tubes 140, 145 may support a glove having a pinky finger 371, a finger 372, 373, 374, and a thumb 375, the first and second glove air exhaust tubes 140, 145 may alternatively, or additionally, support a mitten or the like. The first and/or second glove air exhaust tubes 140, 145 may be configured to be both slidably and rotatably received onto a respective one of the first or second air exhausts 131, 133 such that the first and/or second glove air exhaust tubes 140, 145 may be angled in a desired direction (e.g., angled toward a vehicle driver, angled toward a vehicle passenger, angled toward a vehicle instrument cluster, angled away from a vehicle instrument cluster, angled toward a vehicle HVAC unit outlet, etc.)

In one aspect, a glove dryer 100 of the present disclosure may be embodied in a glove dryer attachment for a boot dryer and/or a garment dryer (e.g., a boot dryer and garment dryer of commonly assigned U.S. Pat. No. 8,393,482 and U.S. patent application Ser. No. 15/336,730) in which a boot dryer attachment flange may be configured to mount on a boot/garment dryer. A panel may be provided on the boot dryer attachment flange; and at least one rib on the panel angularly oriented to the panel and defining longitudinal air duct passages. The air duct passages may include an air inlet passage along one side of the panel, and an air discharge passage along an opposite side of the panel. The ribs and panel may define open airway connections joining the air inlet passage and air discharge passage. The boot/garment dryer attachment may include a configuration (which may be in the form of a baffle) that may be arranged to guide air into the intake passage and outwardly from the discharge passages.

Figure 2A:
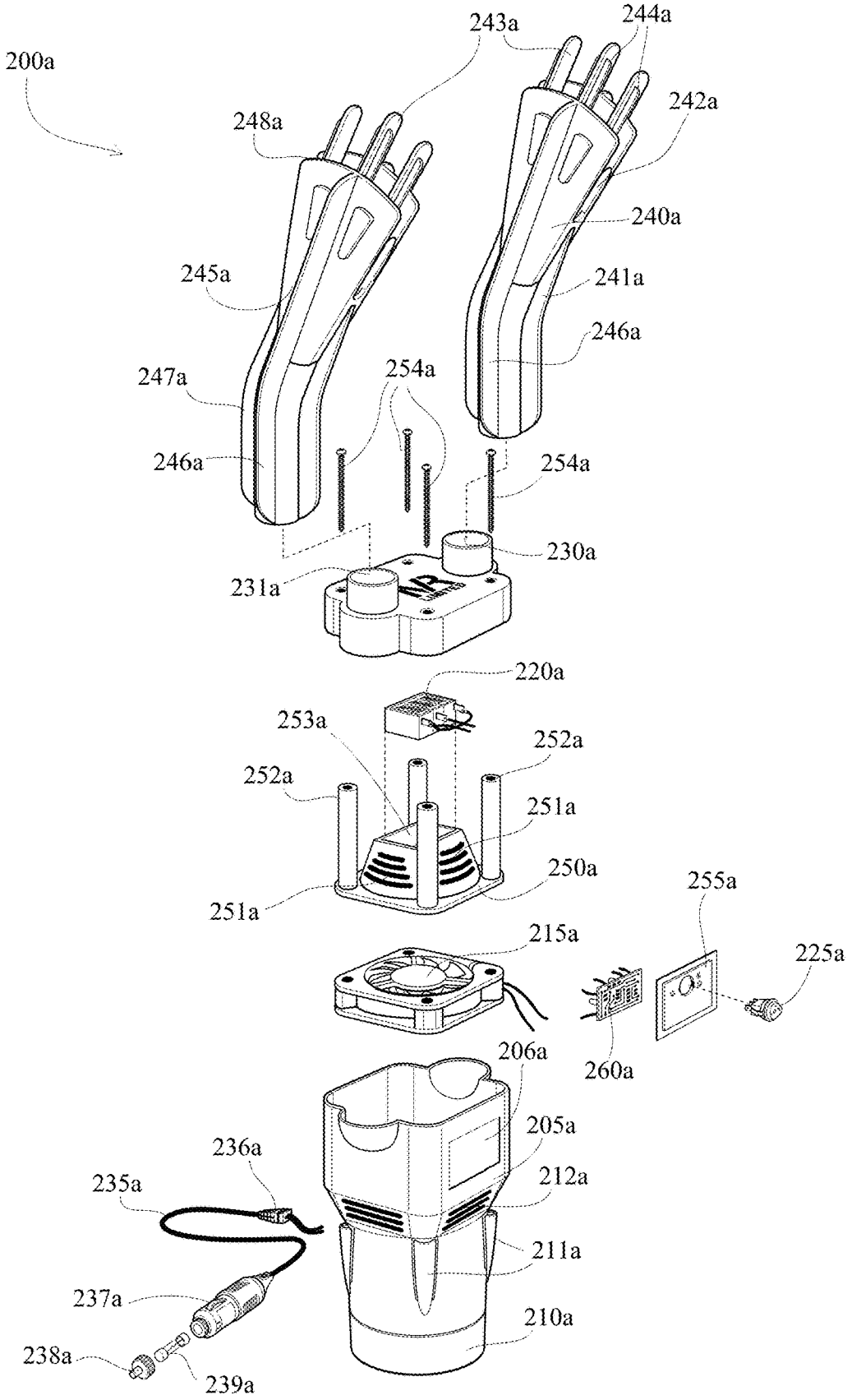
FIG. 2A depicts an exploded view of an example glove dryer.

With reference to FIG. 2A, a glove dryer 200*a* may include a substantially square body 205*a* having a substantially round base 210*a* with tension tabs 211*a* configured to be received within a standard vehicle cup holder (not shown in FIG. 2A) and/or within a receptacle of an associated docking station (e.g., receptacle 706 of the docking station 700 of FIG. 7). Thereby, the glove dryer 200*a* may be maintained in an upright orientation even when an associated vehicle is accelerating, turning, traveling over bumps, decelerating, etc. The glove dryer 200*a* may be similar to, for example, the glove driver 100 of FIG. 1. The substantially square body 205*a* may further include air intake vents 212*a* for air intake to an electric blower (or fan) 215*a*, and a control receptacle 206*a*. The substantially square body 205*a* may be configured to receive the electric blower (or fan) 215*a*, an electric heater element 220*a*, a wind tunnel 250*a*, a controller 260*a*, an associated user control 225*a* (e.g., an on/off/temperature/moisture content selection switch), and an information panel 255*a*. The electric blower (or fan) 215*a*, the wind tunnel 250*a*, and the electric heater element 220*a* may be secured in position within the substantially square body 205*a* via a cover 230*a* and associated fasteners 254*a* received within a respective fastener receptacle 252*a*. The wind tunnel 250*a* may be manufactured from a heat resistant material (e.g., ceramic, carbon fiber, composite, etc.) such that the electric heater element 220*a* is isolated from other components (e.g., the substantially square body 205*a*, the cover 230*a*, and the electric blower (or fan) 215*a*). The wind tunnel 250*a* may include bleed air vents 251*a* configured to circulate air flow from the electric blower (or fan) 215*a* around the electric heater element 220*a*. The cover 230*a* may include a first air exhaust 231*a* for air flow from the electric blower (or fan) 215*a* and a second air exhaust 233*a* for air flow from the electric blower (or fan) 215*a*.

The glove dryer 200*a* may also include an electric supply cable 235*a*, an electric supply cable adapter 236*a*, a cigarette lighter plug 237*a*, 238*a*, and a fuse 239*a*. The electric supply cable adapter 236*a* may be configured to receive other electric supply cables other than that shown in FIG. 2A.

The glove dryer 200*a* may include a first glove air exhaust tube 240*a* and a second glove air exhaust tube 245*a*. The first and second glove air exhaust tubes 240*a*, 245*a* may be configured to sliding engage a respective one of the first and second air exhausts 231*a*, 233*a*. The first and second glove air exhaust tubes 240*a*, 245*a* may include finger shaped supports 243*a* with finger ribs 244*a* configured to direct air flow from the electric blower (or fan) 215*a* into each respective finger of a corresponding glove (e.g., finger 372, 373, 374 of FIG. 3). The first and second glove air exhaust tubes 240*a*, 245*a* may include a thumb air outlet deflector 248*a* configured to direct air flow from the electric blower (or fan) 215*a* into a respective thumb of a corresponding glove (e.g., thumb 375 of FIG. 3). The first and second glove air exhaust tubes 240*a*, 245*a* may include a pinky finger air outlet deflector 248*a* configured to direct air flow from the electric blower (or fan) 215*a* into a respective pinky finger of a corresponding glove (e.g., pinky finger 371 of FIG. 3). The first and second glove air exhaust tubes 240*a*, 245*a* may include wrist ribs 241*a*, 246*a*, 247*a* configured to direct air flow out of the pinky finger 371, a finger 372, 373, 374, and a thumb 375. While the first and second glove air exhaust tubes 240*a*, 245*a* may support a glove having a pinky finger 371, a finger 372, 373, 374, and a thumb 375, the first and second glove air exhaust tubes 240*a*, 245*a* may alternatively, or additionally, support a mitten or the like.

Figure 2B:
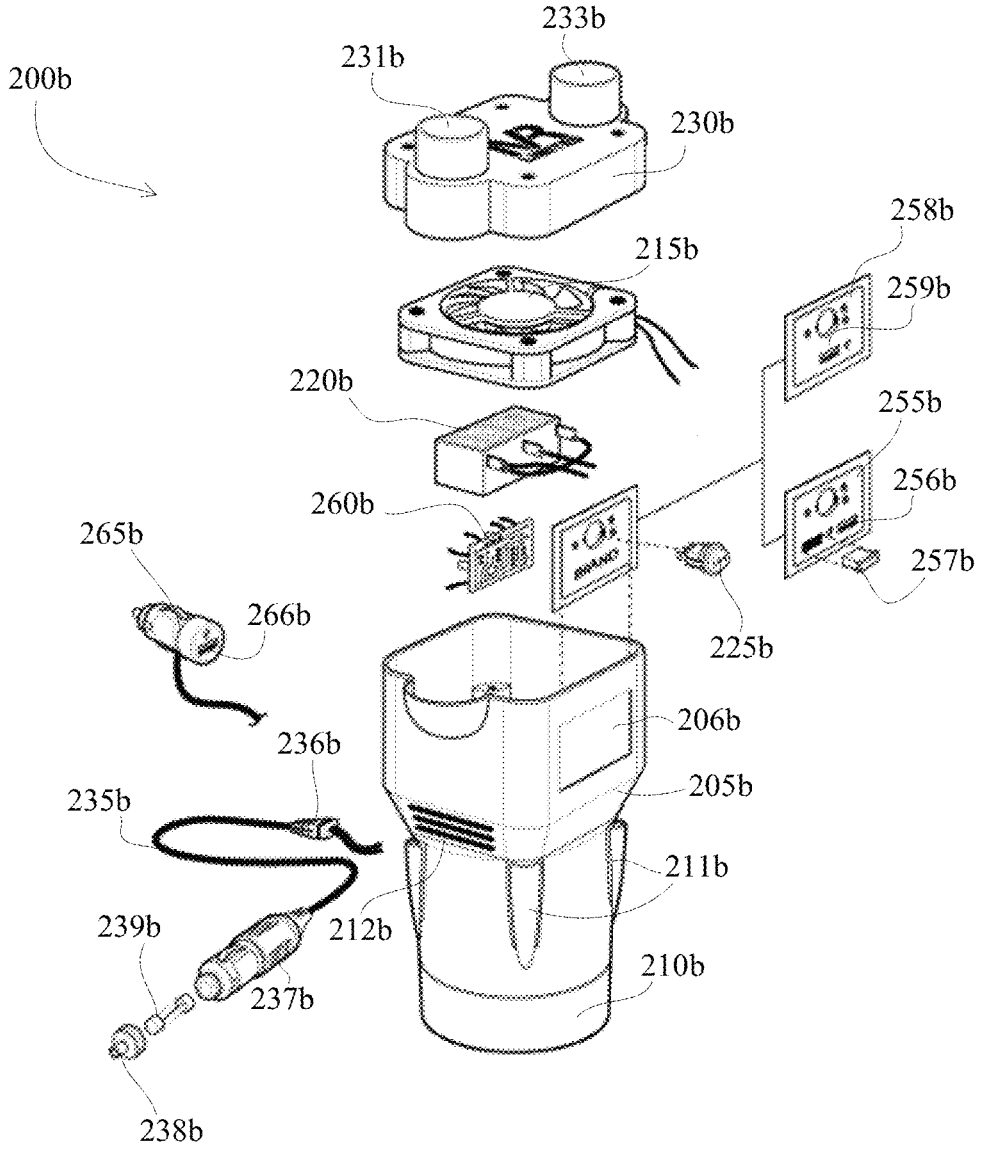
FIG. 2B depicts an exploded view of a portion of an example glove dryer with alternate components shown proximate one another.

Turning to FIG. 2B, a glove dryer 200*b* may include a substantially square body 205*b* having a substantially round base 210*b* with tension tabs 211*b* configured to be received within a standard vehicle cup holder (not shown in FIG. 2B) and/or within a receptacle of an associated docking station (e.g., receptacle 706 of the docking station 700 of FIG. 7). Thereby, the glove dryer 200*b* may be maintained in an upright orientation even when an associated vehicle is accelerating, turning, traveling over bumps, decelerating, etc. The glove dryer 200*b* may be similar to, for example, the glove driver 100 of FIG. 1 or the glove dryer 200*a* of FIG. 2A. The substantially square body 205*b* may further include air intake vents 212*b* for air intake to an electric blower (or fan) 215*b*, and a control receptacle 206*b*. The substantially square body 205*b* may be configured to receive the electric blower (or fan) 215*b*, an electric heater element 220*b*, a controller 260*b*, an associated user control 225*b* (e.g., an on/off/temperature/moisture content selection switch), and an information panel 255*b*. An alternate information panel 258*b* may include a universal serial bus (USB) port 259*b*. Another alternate information panel 255*b* may include a first universal serial bus (USB) port 256*b* and a second universal serial bus (USB) port 257*b*. The electric blower (or fan) 215*b* and the electric heater element 220*b* may be secured in position within the substantially square body 205*b* via a cover 230*b* such that the electric blower (or fan) 215*b* sucks air through the electric heater element 220*b* (i.e., as opposed to the electric blower (or fan) 115*a*, 215*a* blowing air through the electric heater element 120*a*, 220*a*). The cover 230*a* may include a first air exhaust 231*a* for air flow from the electric blower (or fan) 215*b* and a second air exhaust 233*b* for air flow from the electric blower (or fan) 215*b*.

Figure 3:
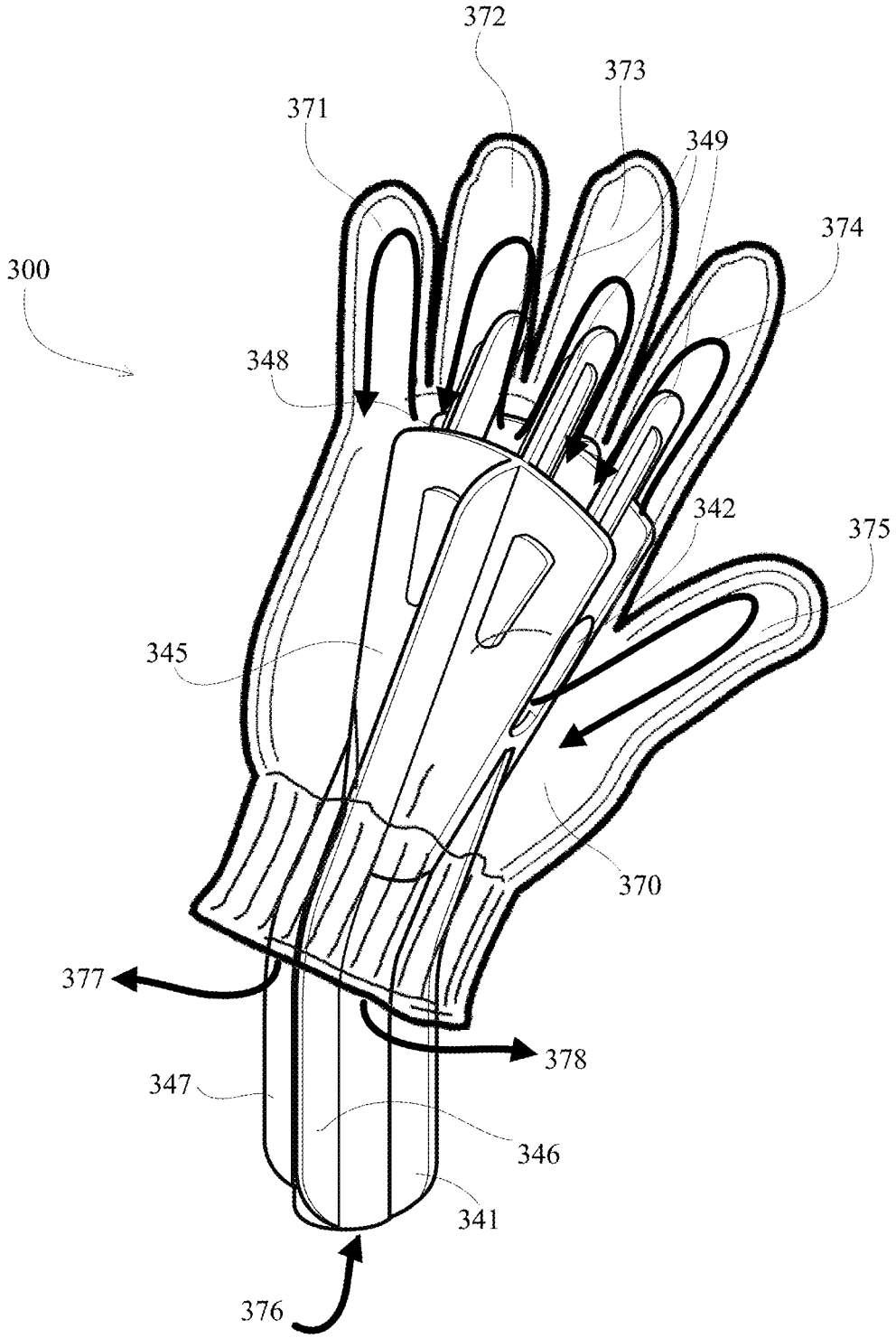
FIG. 3 depicts a glove positioned on an example glove receiver and illustrating air flow.

With reference to FIG. 3, a glove air exhaust tube 345 may include finger shaped supports 349 with finger ribs configured to direct air flow from the electric blower (or fan) (not shown in FIG. 3) into each respective finger 372, 373, 374 of a corresponding glove 370. The glove air exhaust tube 345 may be similar to, for example, either of the glove air exhaust tubes 140, 145 of FIG. 1 or 240*a*, 245*a* of FIG. 2A. The glove air exhaust tube 345 may include a thumb air outlet deflector 342 configured to direct air flow from an electric blower (or fan) (not shown in FIG. 3) into a respective thumb 375 of a corresponding glove 370. The glove air exhaust tube 345 may include a pinky finger air outlet 248*a* configured to direct air flow from the electric blower (or fan) 215*a* into a respective pinky finger 371 of a corresponding glove 370. The glove air exhaust tube 345 may include wrist ribs 341, 346, 347 configured to direct air flow out of the pinky finger 371, a finger 372, 373, 374, and a thumb 375. While the glove air exhaust tube 345 may support a glove having a pinky finger 371, a finger 372, 373, 374, and a thumb 375, the glove air exhaust tube 345 may alternatively, or additionally, support a mitten or the like. In either event, air flow 376 may enter the glove air exhaust tube 345, circulate through the pinky finger 371, the fingers 372, 373, 374, and the thumb 375 and out through the wrist 378, 379. In any event, the glove air exhaust tube 345 is configured such that the glove 370 may be placed over the glove air exhaust tube 345 with one hand (i.e., placement of the glove 370 over the glove air exhaust tube 345 may not require both hands).

Figure 4A:
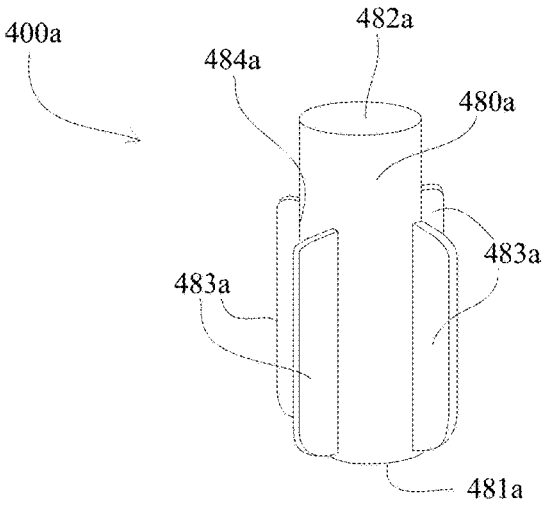
FIGS. 4A-4C depict various example components for use with a glove dryer of FIGS. 1, 2A and 2B.

Turning to FIG. 4A, an extension 400*a* may include an air conduit body 480*a* having an air inlet 481*a*, and air outlet 482*a*, and air ribs 483*a* forming air passageways 484*a*. The extension 400*a* may be placed between a first or second air exhaust 131, 133 and a respective glove air exhaust tube 140, 145 to, for example, extend an associated wrist section to accommodate a longer glove (e.g., snowmobile glove, ski glove, etc.). Alternative, the air outlet 482*a* may be closed off and the extension 400*a* may be placed over a first or second air exhaust 131, 133 to block off air flow from the respective air exhaust 131, 133. Thereby, more air may flow out of the air exhaust 131, 133 that is not blocked off.

Figure 4B:
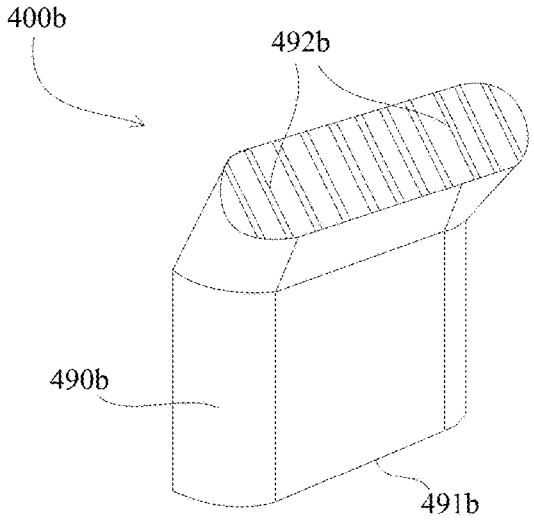

With reference to FIG. 4B, an air exhaust tube 400*b* may include an air inlet 491*b* configured to be slidingly placed over the first and second air exhausts 131, 133, an air conduit body 490*b*, and an air outlet 492*b*. The air exhaust tube 400*b* may be configured as a hand warmer, a windshield defroster, a space heater, etc. when combined with, for example, the glove dryer 200*b* of FIG. 2B.

Figure 4C:
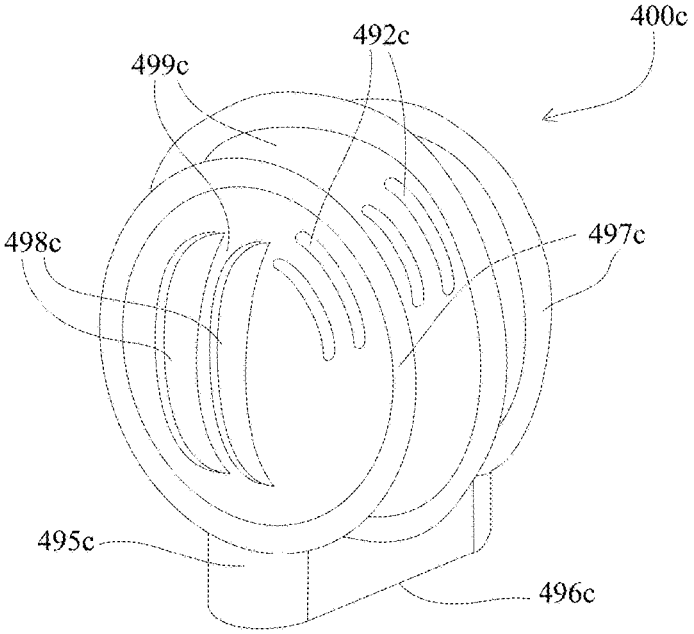

Turning to FIG. 4C, an air exhaust tube 400*c* may include an air conduit body 495*c* having an air inlet 496*c*, air outlets 492*c*, and ribs 497*c*, 498*c* forming air flow passageways 499*c*. The air exhaust tube 400*c* may be configured as a hat warmer/dryer, a windshield defroster, a space heater, a helmet warmer/dryer, etc. when combined with, for example, the glove dryer 200*b* of FIG. 2B.

Figure 5A:
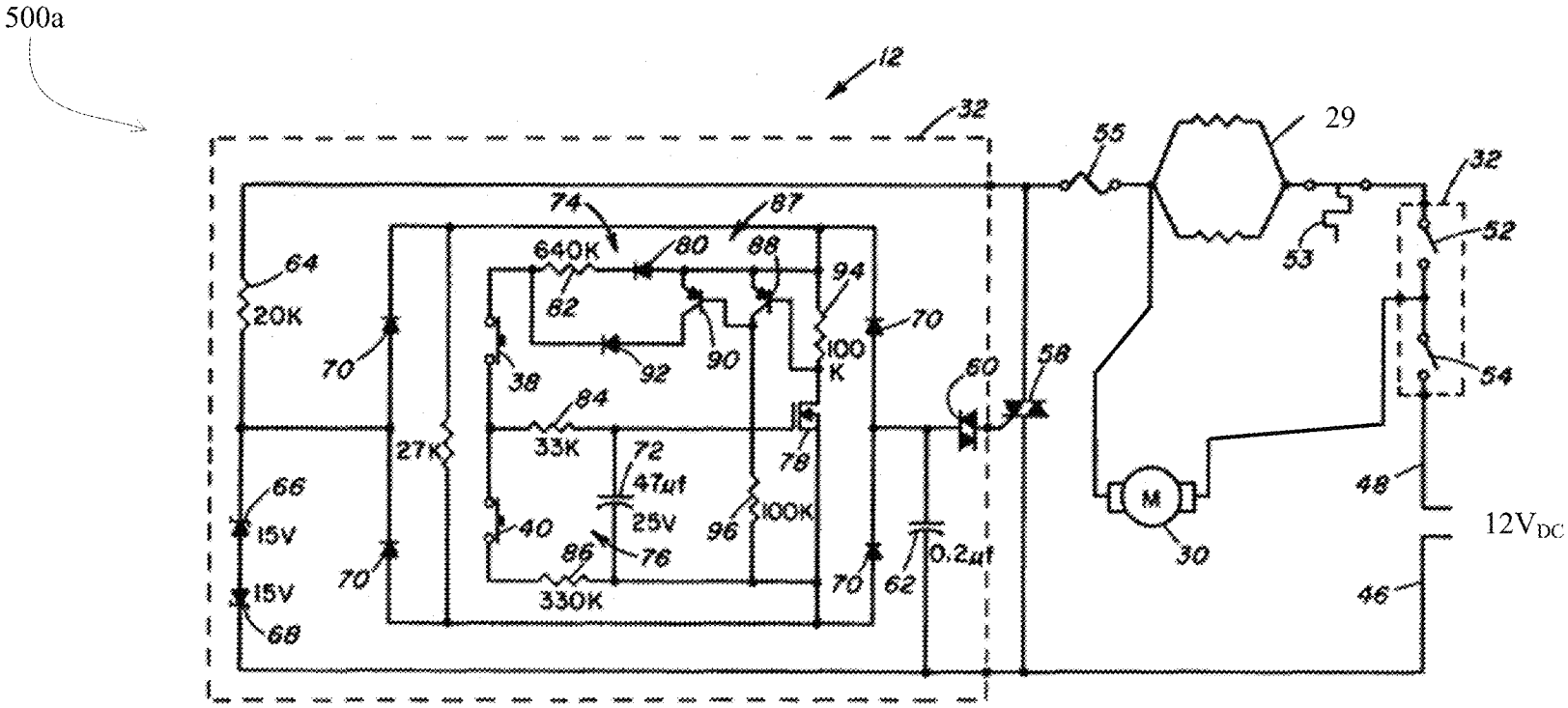
FIG. 5A depicts an example electrical control circuit for use with a glove dryer of FIGS. 1, 2A and 2B.

With reference to FIG. 5A, a controller 500*a* may include a control circuit 12 having a power control subcircuit 42 electrically coupled to the heater element 29 and blower motor 30 and being operable for regulating operation of the heater element 29 and blower 30, and a phase control subcircuit 44 coupled to the power control subcircuit 42 and being operable for regulating operation of the power control subcircuit 42 to thereby, in turn, regulate operation of the heater element 29 and blower 24. A pair of line conductor leads 46, 48 of an electrical power cord 50 are connected to the power control subcircuit 42 and the phase control circuit 44 to apply thereto a suitable source of power, such as a 125 volt 60 hertz a.c. electrical signal. Also, a pair of cool shot switch 52 and on-off switch 54 (for the heater elements 29 and the blower motor 30, respectively), a thermostat 53, a thermal fuse 55 and a first diode bridge rectifier subcircuit 56 are interconnected to each other and to the pair of conductor leads 46, 48 of the power cord 50, as shown in FIG. 5A.

The power control subcircuit 42 may include a triac 58 connected at one side to the one line conductor lead 46 and at the opposite side to the heater elements 29 and to the blower motor 30 via the first diode bridge rectifier subcircuit 56, a diac 60 connected to the gate of the triac 58, a main capacitor 62 connected between the one line conductor lead 46 and the diac 60. Also, the power control subcircuit 42 includes a fixed resistor 64 and a pair of oppositely facing zener diodes 66, 68 connected in series between the one line conductor lead 46 and the opposite side of the triac 58 to restrict and regulate the voltages of the positive and negative applied to a voltage control subcircuit.

Referring still to FIG. 5A, the phase control subcircuit may include diodes 70 connected to form a second diode bridge rectifier subcircuit providing correct polarity for other elements of the subcircuit, a secondary capacitor 72, a charging subcircuit portion 74 connected across the secondary capacitor 72, a discharging subcircuit portion 76 connected across the secondary capacitor 72 and an output control driver 78 in the form of a MOSFET transistor Q4 connected respectively at its source and gate across the secondary capacitor 72. The resistance of the output control driver 78 for turning on and conducting current is variable depending on the voltage between its gate and source. The voltage stored by the secondary capacitor 72 determines the voltage between the gate and source of the output control driver 78. As the voltage across the secondary capacitor 72 is increasing when the charging subcircuit portion 74 is charging the secondary capacitor 72, the resistance across the gate and source of the output control driver 78 is decreasing. On the other hand, as the voltage across the secondary capacitor 72 is decreasing when the discharging subcircuit portion 76 is discharging the secondary capacitor 72, the resistance across the gate and source of the output output driver 78 is increasing.

The "up" and "down" momentary switches 52, 54 (which may be identified as U and D switches respectively on the information plates 255*a*, 255*b*, 258*b* in FIGS. 2A and 2B) are connected to the voltage control subcircuit and specifically interposed in the charging and discharging subcircuit portions 74, 76 thereof. When the "up" momentary switch 52 is depressed, the secondary capacitor 72 starts to charge through the operation of the charging subcircuit portion 74 (composed of diode 80 and resistors 82, 84). The voltage across the secondary capacitor 72 increases and, in response thereto, the resistance of the output control driver 78 decreases. When the threshold voltage (or resistance) of the output control driver 78 is reached, the output control driver 78 starts to conduct a current which continues to increase in quantity as the voltage across the secondary capacitor 72 continues to increase in response to the continued retention of depression of the "up" momentary switch 52 by the user and continued charging of the charging subcircuit portion 74. The increasing quantity of current from the output control driver 78 of the voltage control subcircuit controls the power control subcircuit 32 to conduct a corresponding increasing quantity of current to the heater element 29 and blower motor 30 and accordingly increase the intensity of the heat output and the speed of the air flow output produced thereby.

On the other hand, when the "down" momentary switch 54 is depressed, the secondary capacitor 72 begins to discharge through the discharging subcircuit portion 76 (composed of resistors 84, 86). The voltage across the secondary capacitor 72 decreases and, in response thereto, the resistance of the output control driver 78 increases and the current conducted by the output control driver 78 accordingly decreases and continues to decrease as the voltage across the secondary capacitor 72 continues to decrease in response to the continued retention of depression of the "down" momentary switch 54 by the user and continued discharging of the discharging subcircuit portion 76. The decreasing current from the output control driver 78 of the voltage control subcircuit controls the power control subcircuit 32 to conduct a decreasing quantity of current to the heater element 29 and blower motor 30 and accordingly decrease the intensity of the heat output and the speed of the air flow output produced thereby.

When the depression of the respective one of the momentary switches 52, 54 is removed, the secondary capacitor 72 terminates either charging or discharging in response the termination of operation of the respective charging and discharging subcircuit portions 74, 76 of the voltage control subcircuit. The secondary capacitor 72 will maintain, for a long period of time, the voltage it had across it when the last one of the momentary switch 52, 54 was released. Thus, the last settings of the heat output intensity and air flow output speed will be maintained until changed by the user again operating the respective momentary switches 52, 54 to change the settings.

When the secondary capacitor 72 is completely discharged, it takes a period of time longer than desirable to charge it up to the near the threshold voltage required to turn on the output control driver 78. The voltage control subcircuit also includes an auxiliary charging subcircuit portion 87 (composed of transistors 88 and 90, diode 92 and resistors 94 and 96) to assist in speeding up the initial charging of the secondary capacitor 72. It should be observed that current through the output control driver 78 is the same current through the base of the one transistor 88 of the auxiliary charging subcircuit portion 87. The transistor 88 is turned on by this current and blocks the base current of the other transistor 90, thereby turning off and eliminating any additional charge path for the secondary capacitor 72 so that after initial charging of the secondary capacitor 72 is completed, the secondary capacitor 72 is thereafter only charged by the charging subcircuit portion 74.

As mentioned above, the momentary switches 52, 54, respectively labelled "U" for "up" and "D" for "down" are manipulatable by the user to actuate the respective charging and discharging subcircuit portions 74, 76 of the voltage control subcircuit of the control circuit 12 to continuously vary operation of the power control subcircuit 32 of the control circuit 12 and thereby regulate the operation of the heater element 29 and blower 24 in order to select any desired heat intensity output of the heater element 29 and any desired air flow speed output of the blower 30 so as to produce a heated air flow output having a desired heat intensity and air flow speed within the respective continuous ranges thereof. The longer the period of time that the "up" momentary switch 52 is held depressed by the user, the more the heat intensity output and air flow speed output of the heated air flow output are increased. The longer the period of time that the "down" momentary switch 54 is held depressed by the user, the more the heat intensity output and air flow speed output of the heated air flow output are decreased.

Figure 5B:
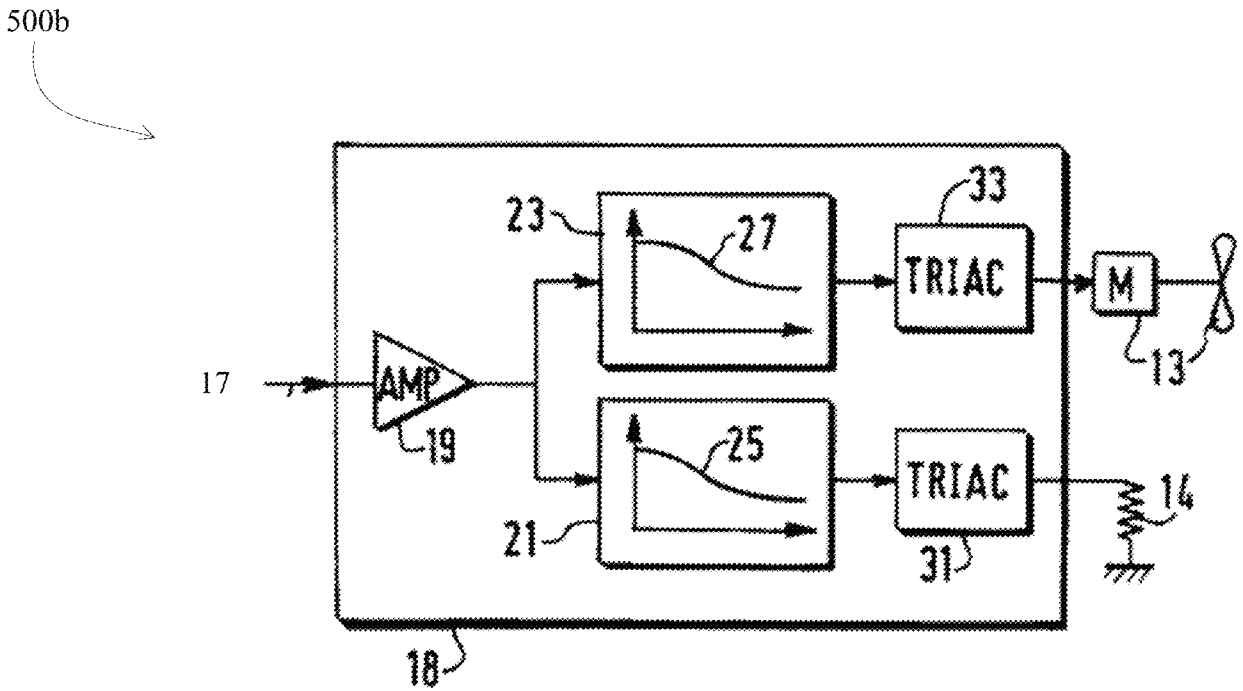
FIG. 5B depicts an example electrical control circuit for use with a glove dryer of FIGS. 1, 2A and 2B.
Figure 6A:
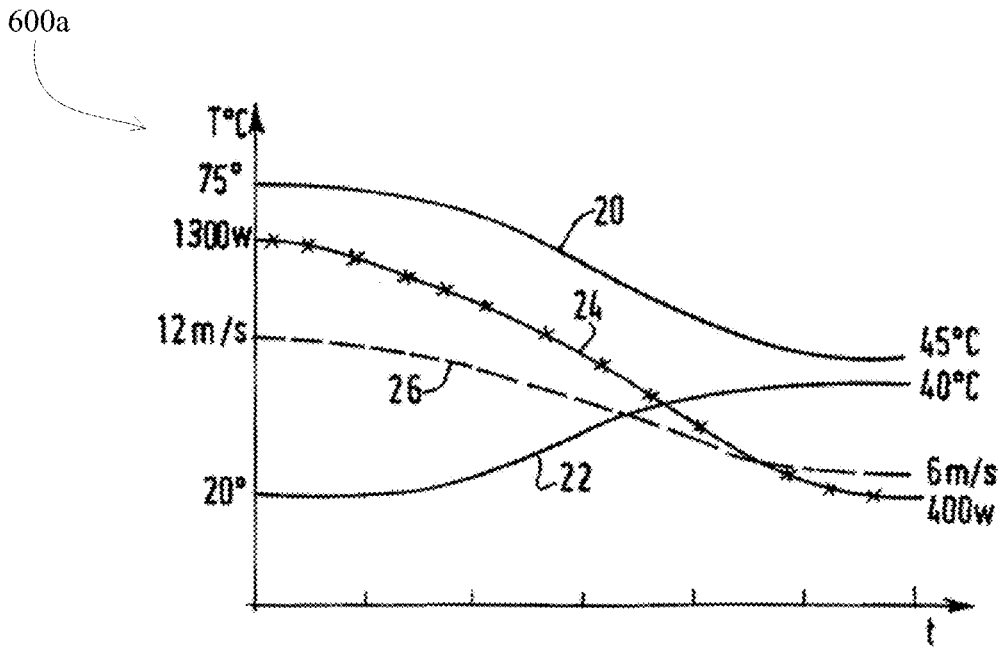
FIG. 6A contains graphs showing example automatic variations in air temperature, glove temperature, air flow rate, and electric power dissipated in a heater element during an operational sequence of a glove dryer of FIG. 1, 2A or 2B.
Figure 6B:
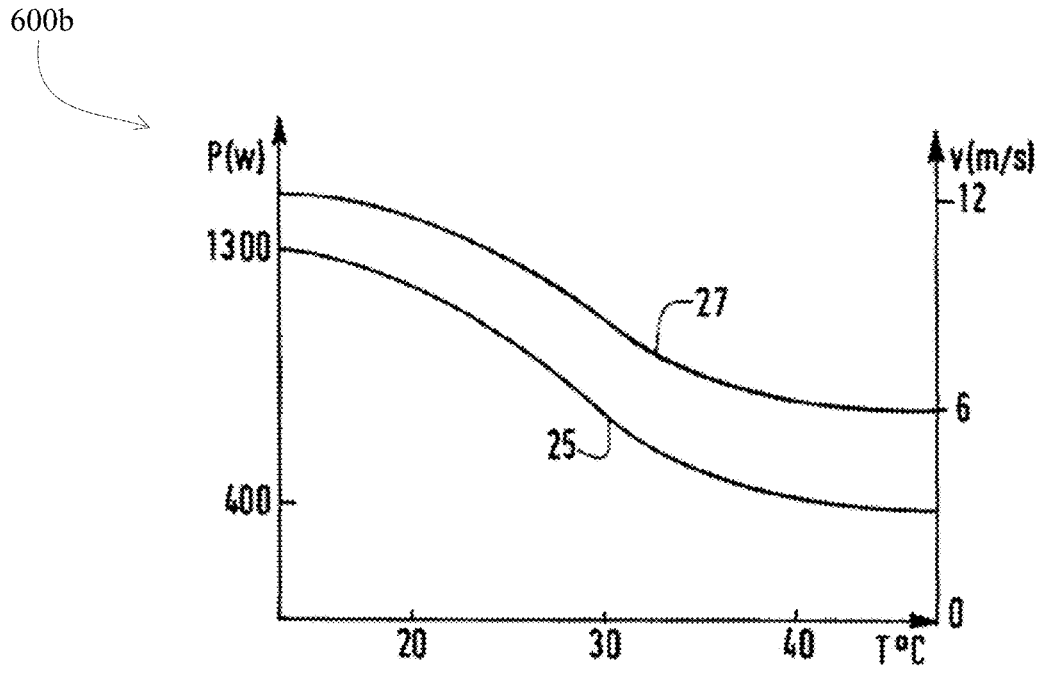
FIG. 6B contains typical curves indicating variations in electric power dissipated in a heater element and variations in air flow delivered by a fan as a function of glove temperature within a glove dryer of FIG. 1, 2A or 2B.

Turning to FIG. 5B, control means 18 may include signal 17 input to a signal amplifier 19 followed by two analog circuits 21 and 23 so that the analog circuits may control on the one hand heating power and on the other hand air flowrate via appropriate transistor or triac circuits 31 and 33, respectively, in accordance with the characteristics 25 and 27 shown in FIGS. 6A and 6B. These characteristics are preferably non-linear, as is shown in FIGS. 6A and 6B. They may have a different shape. In an alternative embodiment, the analog circuits may be replaced by digital processing circuits comprising analog-digital converters, digital correspondence tables which provide the characteristics 25 and 27, and digital-analog converters which control the above power circuits.

When a user moves the glove dryer 100, 200A, 200B towards a zone which is still wet, and accordingly still cold, the temperature detector 20 may detect a lower glove temperature, so that the control means 18 immediately readjust the heating power and/or the air flow in accordance with the curves given in FIGS. 6A and 6B. Means 20 for measuring heat radiation emitted by the glove may be used, for example, an infrared detector. The detector 20 may be connected to the control means 18 so as to regulate air circulation means 13 and the heating means 14 in dependence on the temperature measured on the glove. To achieve this, the control means 18 may cause an automatic joint variation in the temperature and the flowrate of the air.

An example illustrating these automatic variations is shown in FIGS. 6A and 6B. In these Figures, the case is represented in which the glove dryer remains permanently directed at a same zone of the glove. Curve 20 may represent variations in time of the temperature $T_a$ of the air at approximately 9 cm from the outlet nozzle 12. Curve 22 may represent variations in time of the glove temperature $T_h$ measured by the detector 20. Curve 24 may represent variations in time of the electric power P dissipated in the heating means 14. Curve 26 may represent variations in time of the speed S of the air at approximately 9 cm from an air exhaust 131, 133.

The case is considered in which a drying operation starts with a wet glove having a temperature $T_h$=20° C. and a glove dryer which has the following characteristics at the start: P=1300 W, S=12 m/s, $T_a$=75° C. The control means 18 may automatically cause the settings of the glove dryer to vary so as to change from strong drying at the start to a progressively more moderate drying, ending with a weak drying effect at the end of the cycle.

It may be desired, for example, that the glove temperature is at most 40° C. at the end of the drying process in order to achieve user comfort. To achieve this, the temperature of the air coming from the glove dryer may be progressively reduced from $T_a$=75° C., to $T_a$=45° C., for example. A small gap between $T_a$ and $T_h$ may be provided. Since the glove may become progressively more fluid during the drying process, the control means 18 may reduce the air flowrate correspondingly, for example, from 12 m/s to 6 m/s so as to prevent that the glove becomes too much dispersed by the air flow. The electrical heating power may also be reduced, for example, from 1300 W down to 400 W. It may be recommended to reduce the electrical power while the air flow is decreasing so as not to risk damaging the glove dryer.

Table I shows, by way of example, control data observed to accompany conditions of comfort and safety.

TABLE I

| | drying: | | | |
|---|---|---|---|---|
| | Air flow | Heating power | Temperature $T_a$ | Temperature $T_h$ |
| strong | 12 m/s | 1300 W | 75° C. | 20° C. |
| normal | 10.5 m/s | 1000 W | 70° C. | 23° C. |
| moderate | 8.2 m/s | 750 W | 56° C. | 35° C. |
| weak | 6 m/s | 400 W | 45° C. | 40° C. |

FIGS. 6A and 6B show example of a curve 25 showing variations in heating power, and a curve 27 of air flowrate which may be suitably applied as a function of the temperature of the glove 371 detected by the detector 20. The curves may relate to a glove zone which is subjected to the influence of the drying process at a given moment and which is monitored by the detector 20.

It is possible to use any detector capable of measuring an infrared radiation emitted by the glove 371. This may be a detector described in the document GB 2,093,343 A, or any other detector. Preferably, a detector is used formed by a plurality of elementary cells which generate a thermal electric power. One cell is formed by a stack of conductor and/or semiconductor layers such that the cell develops an electrical potential difference induced in response to a heat flow. Such a detector is described, for example, in the document FR 2,471,055 and FR 2,598,803.

With reference to FIG. 7, a docking station/carrying case 700 may include a base 705 and a cover 715. The base 705 may include a glove dryer receptacle 706, a cigarette lighter plug receptacle 707, a power cord 708 having a plug 709 with prongs 710, an on/off switch 711, a transformer/rectifier 712 and a battery 713. A glove dryer 100, 200*a*, 200*b* may be received within the glove dryer receptacle 706 and a cigarette lighter plug 137/138, 237*a*/238*a*, 237*b*/238*b* may be inserted into the cigarette lighter plug receptacle 707.

Thereby, the glove dryer 100, 200*a*, 200*b* may be powered by the battery 713 or via a 110/220 Vac outlet through the plug 709. The base 705 with battery 713 and transformer/rectifier 712 may be heavy enough that the docking station/carrying case 700 may be placed on a vehicle floor or seat and the glove dryer 100, 200*a*, 200*b* may be retained in an upright orientation even when the vehicle is accelerating, turning, traveling over bumps, decelerating, etc. The glove dryer receptacle 706 may be similar to, for example, a standard vehicle cup holder. Thereby, the docking station/carrying case 700 may be used as a cup holder. The docking station/carrying case 700 may include a plurality of glove dryer receptacles 706.

The cover 715 may include an air filter (e.g., a carbon filter, an odor absorbing filter, etc.), a carrying handle 717, and at least one base latch 718. The cover 715 may be configured to draw outside air into the glove dryer 100, 200*a*, 200*b* and/or circulate inside air through the glove dryer 100, 200*a*, 200*b*.

Figure 8:
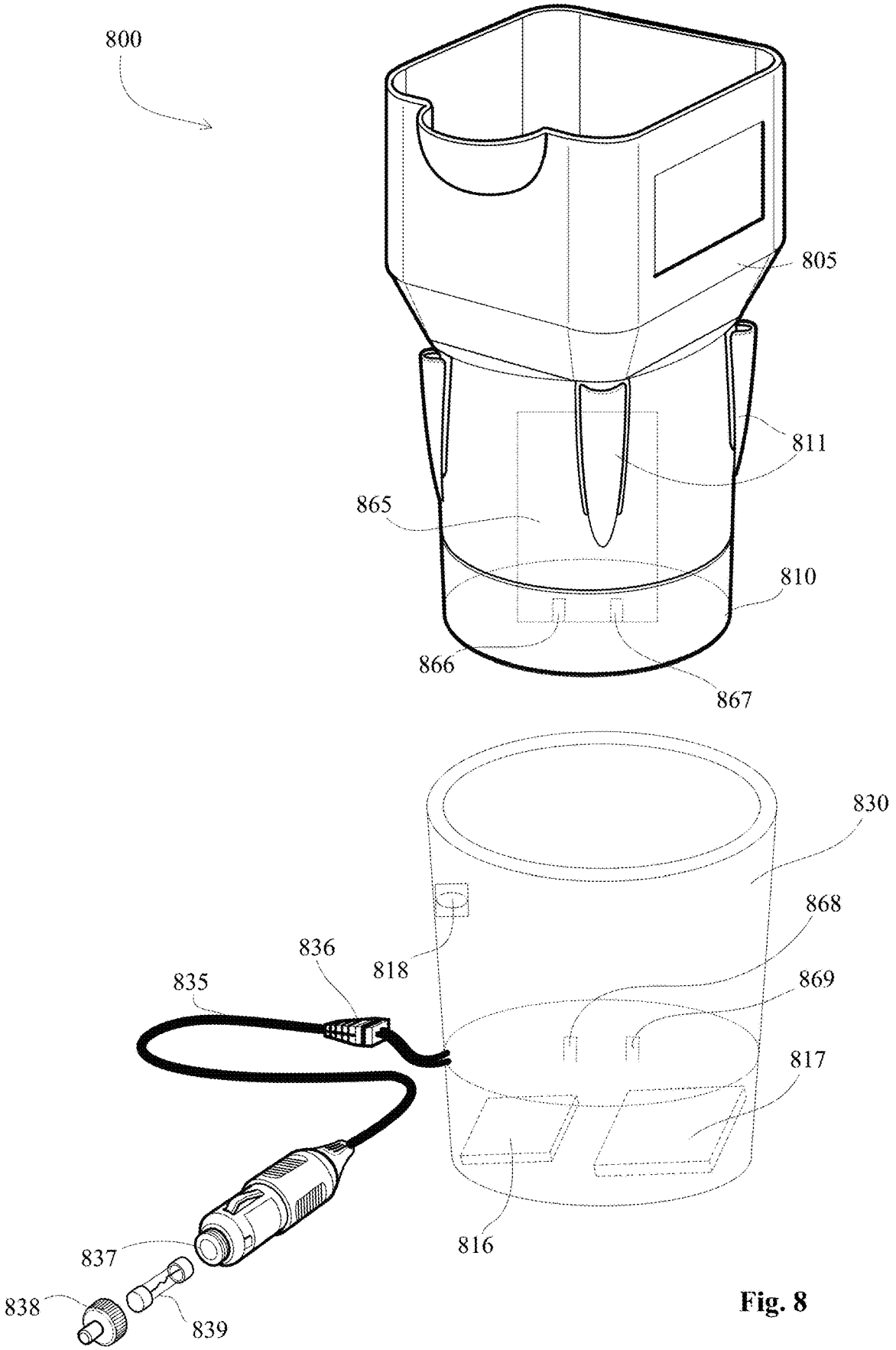
FIG. 8 depicts an example glove dryer having an internal battery and an associated docking station.

Turning to FIG. 8, a glove dryer 800 may include a battery 865 located, for example, in a substantially round base 110 such that receptacles 866, 867 receive mating posts 868, 869 when the glove dryer 800 is inserted into an associated docking station 830. The glove dryer 800 may be similar to, for example, the glove dryer 100 of FIG. 1, the glove dryer 200*a* of FIG. 2A, or the glove dryer 200*b* of FIG. 2B. The glove dryer 800 may include a substantially square body 805 with the substantially round base 810 having tension tabs 811 configured to be received within a standard vehicle cup holder and/or the docking station 830. The base 810 with battery 865 may be placed within, for example, a standard vehicle cup-holder and the glove dryer 800 may be retained in an upright orientation even when an associated vehicle is accelerating, turning, traveling over bumps, decelerating, etc.

The docking station 830 may include a charging circuit 816, a battery 817, an on/off switch 818, an electric supply cable 835, an electric supply cable adapter 836, a cigarette lighter plug 837, 838, and a fuse 839. Alternatively, or additionally, the docking station 830 may include a 110/220 Vac cable and a plug with prongs (e.g., cable 708, plug 709, prongs 710 of FIG. 7). The docking station 830 may include and transformer/rectifier (e.g., transformer/rectifier 712 of FIG. 7). The base 810 with battery 865 may be heavy enough that, when the docking station 830 is placed within, for example, a standard vehicle cup-holder, the glove dryer 800 may be retained in an upright orientation even when an associated vehicle is accelerating, turning, traveling over bumps, decelerating, etc. An interior space of the docking station 830 may be similar to, for example, a standard vehicle cup holder. Thereby, the docking station 830 may be used as a cup holder. The docking station 830 may include a plurality of glove dryer receptacles (e.g., glove dryer receptacles 706 of FIG. 7) proximate to, or surrounding, the portion of the docking station 830 that is inserted into a standard vehicle cup holder.

The docking station 830 may include additional trays, slots, tubes, etc. configured to receive other items (e.g., a cell phone, a pen, a pencil, sunglasses, glasses, keys, a key fob, a garage door opener, etc.). The docking station 830 may include additional receptacles (e.g., a universal serial bus (USB) receptacle, a headphone receptacle, a standard 110 Volt outlet, a cellular telephone charging receptacle, etc.).

The battery 865 and/or the battery 817 may be capable of providing electrical energy to the glove dryer for a predetermined period of time (e.g., fifteen minutes, thirty minutes, etc.). For example, an associated heating element (e.g., heating element 120 of FIG. 1) may be 100 W and an associated electric blower (or fan) (e.g., electric blower (or fan) 115 of FIG. 1) may be 10 W. Accordingly, a 55 Watt-hour battery 865, 817 may supply electrical energy to the glove dryer 800 for approximately thirty minutes.

In an alternative embodiment, the glove dryer 800 may include a charging circuit 816 and/or a transformer/rectifier (e.g., transformer/rectifier 712 of FIG. 7) along with a 110/220 Vac cable and a plug with prongs (e.g., cable 708, plug 709, prongs 710 of FIG. 7). Thereby, the battery 865 may be charged directly from, for example, a 110 Vac electric power supply.

With reference to FIGS. 9A-9D, a glove dryer 900*a-c* may include a substantially square body 905*a-c* having a base defining a substantially round shape cross section 910*a-c* with tension tabs 911*a-c* configured to be received within a standard vehicle cup holder (not shown in FIGS. 9A-9C) and/or within a receptacle of an associated docking station (e.g., receptacle 706 of the docking station 700 of FIG. 7). Thereby, the glove dryer 900*a-c* may be maintained in an upright orientation even when an associated vehicle is accelerating, turning, traveling over bumps, decelerating, etc. The glove dryer 900*a-c* may be similar to, for example, the glove dryer 100 of FIG. 1 and/or the glove dryer 200*a* of FIG. 2A. The substantially square body 905*a-c* may further include air intake vents 912*a-c* for air intake to an electric blower (or fan) 915*b,c*, and a control panel receptacle. The substantially square body 905*a-c* may be configured to receive the electric blower (or fan) 915*b,c*, an electric heater element 920*b,c*, a wind tunnel (or baffles) (not shown in FIGS. 9A-9C) formed in the cover 930*a-c*, an over temperature sensor/shutoff 921*b,c*, an associated user control 925*a-c* (e.g., an on/off/temperature/moisture content selection switch), and an information panel. The electric blower (or fan) 915*b,c*, the wind tunnel (or baffles), and the electric heater element 920*b,c* may be secured in position within the substantially square body 905*a-c* via a cover 930*b,c* and associated fasteners 954*a-c* received within a respective fastener receptacle 952*a-c*. The wind tunnel (or baffles) may be manufactured from a heat resistant material (e.g., ceramic, carbon fiber, composite, etc.) such that the electric heater element 920*b,c* is isolated from other components (e.g., the substantially square body 905*a-c*, the cover 930*b*, and the electric blower (or fan) 915*b,c*). The wind tunnel (or baffles) may include bleed air vents configured to circulate air flow from the electric blower (or fan) 915*b,c* around the electric heater element 920*b,c*. The cover 930*b* may include a first air exhaust 931*a-c* for air flow from the electric blower (or fan) 915*b,c* and a second air exhaust 933*a-c* for air flow from the electric blower (or fan) 915*b,c*.

The glove dryer 900*a-c* may also include an electric supply cable 935*a-c*, an electric supply cable adapter 936*a-c*, a cigarette lighter plug 937*a-c*, 938*a-c*, and a fuse 939*a-c*. The electric supply cable adapter 936*a-c* may be configured to receive other electric supply cables other than that shown in FIGS. 9A-9C.

The glove dryer 900*a-c* may include a first glove air exhaust tube 940*a-c* and a second glove air exhaust tube 945*a,b*. The first and second glove air exhaust tubes 940*a-c*, 945*a,b* may be configured to sliding engage a respective one of the first and second air exhausts 931*a-c*, 933*a-c*. The first and second glove air exhaust tubes 940*a-c*, 945*a,b* may include finger shaped supports 943*a-c* with finger ribs 944*a,b* configured to direct air flow from the electric blower (or fan) 915*b,c* into each respective finger of a corresponding glove (e.g., finger 372, 373, 374 of FIG. 3). The first and second glove air exhaust tubes 940*a-c*, 945*a,b* may include a thumb air outlet deflector 948*a,b* configured to direct air flow from the electric blower (or fan) 915*b,c* into a respective thumb of a corresponding glove (e.g., thumb 375 of FIG. 3). The first and second glove air exhaust tubes 940*a-c*, 945*a,b* may include a pinky finger air outlet deflector 948*a,b* configured to direct air flow from the electric blower (or fan) 915*b,c* into a respective pinky finger of a corresponding glove (e.g., pinky finger 371 of FIG. 3). The first and second glove air exhaust tubes 940*a-c*, 945*a,b* may include wrist ribs 941*a-c*, 946*a,b*, 947*a,b* configured to direct air flow out of the pinky finger 371, a finger 372, 373, 374, and a thumb 375. While the first and second glove air exhaust tubes 940*a-c*, 945*a,b* may support a glove having a pinky finger 371, a finger 372, 373, 374, and a thumb 375, the first and second glove air exhaust tubes 940*a-c*, 945*a,b* may alternatively, or additionally, support a mitten or the like.

Figure 9A:
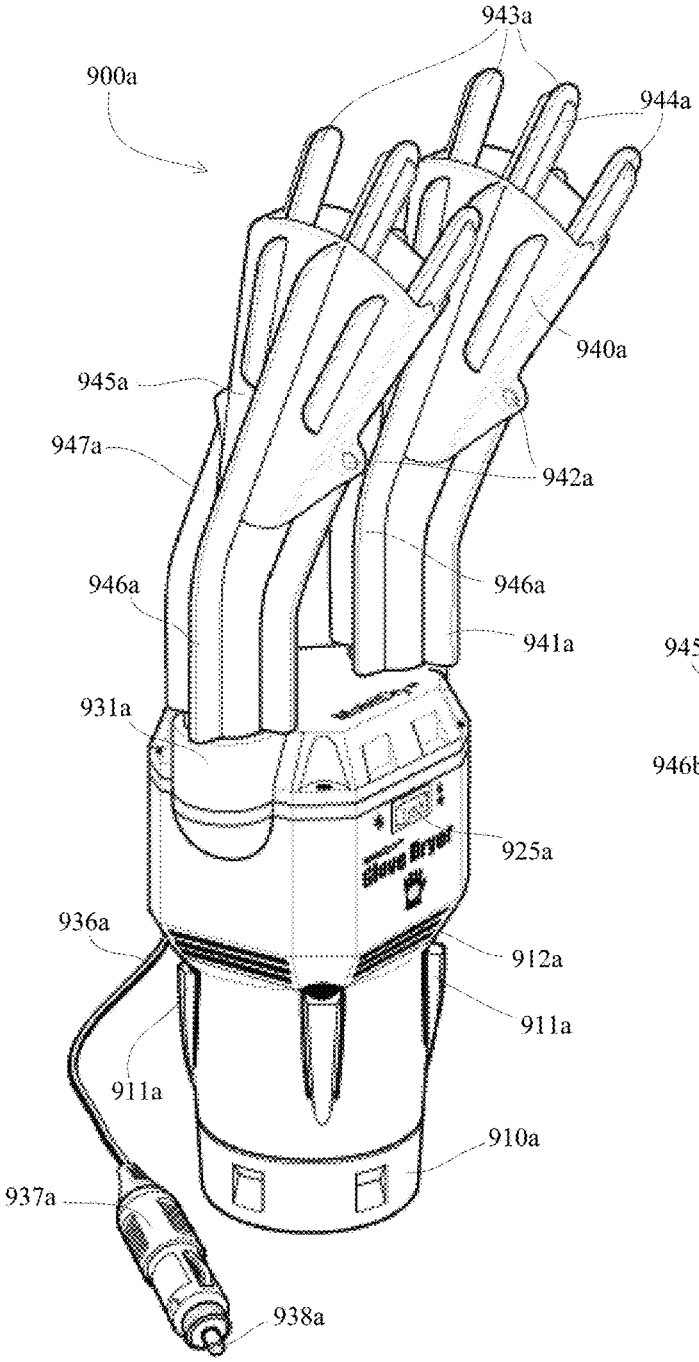
FIGS. 9A-9D depict various views of an example glove dryer and components within the example glove dryer.
Figure 9B:
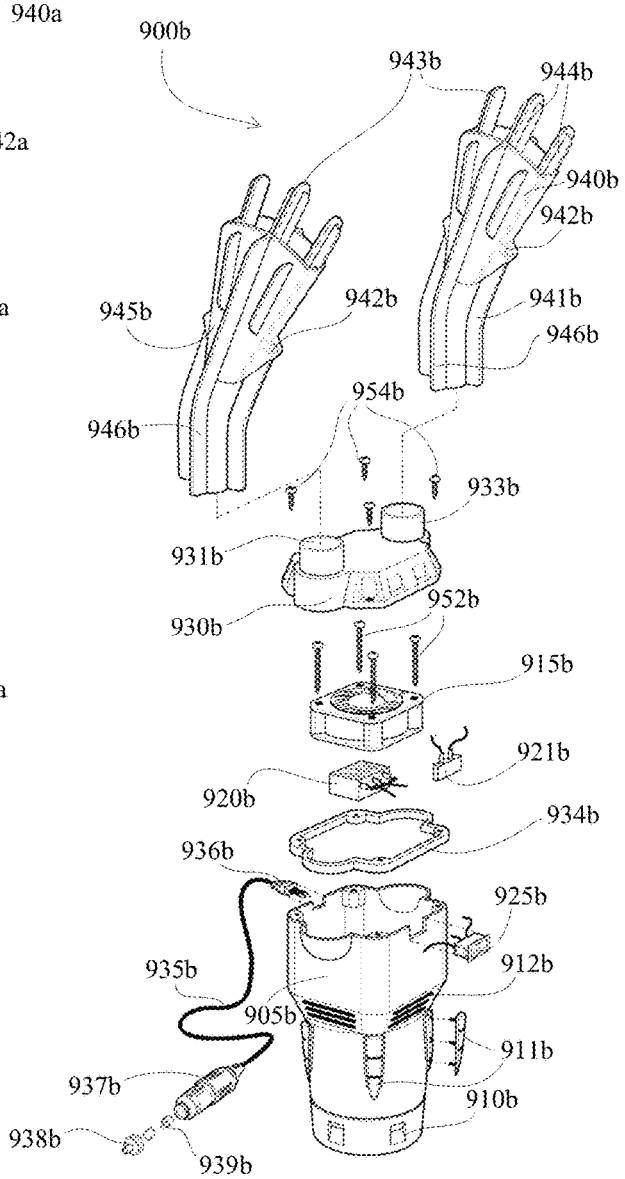
Figure 9D:
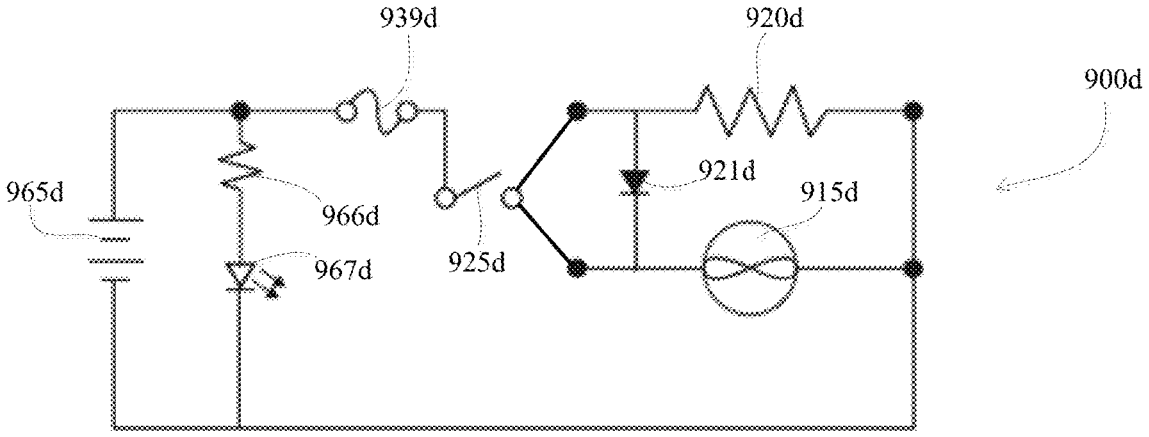
Figure 9C:
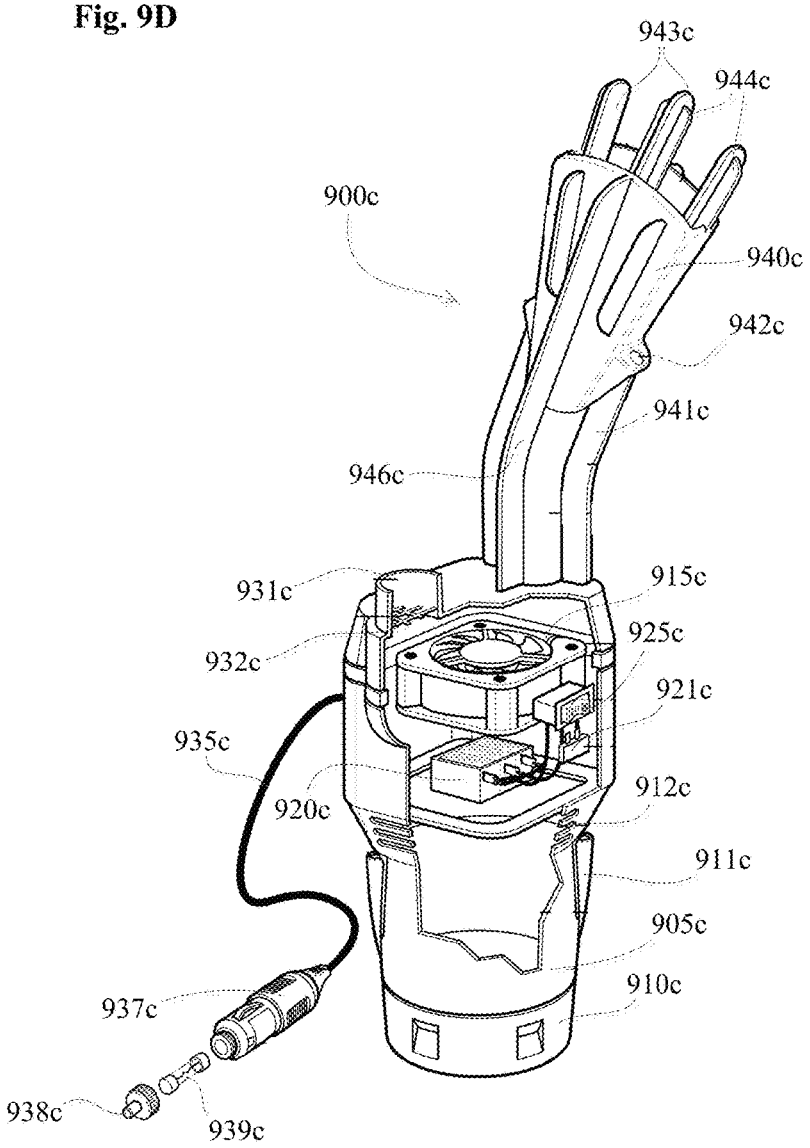

In any event, the first and second glove air exhaust tubes 940*a-c*, 945*a,b* may be similar to, respectively, the first and second glove air exhaust tubes 240*a*, 245*a* of FIG. 2A except that a distance between the pinky finger 371 and thumb 375 may, of FIGS. 9A-9C, may be reduced (e.g., 2⅜" to 2½"). The first and second glove air exhaust tubes 940*a-c*, 945*a,b* may be a specific size to allow a glove to be placed over the first and second glove air exhaust tubes 940*a-c*, 945*a,b*. For example, a space between fingers and an air outlet may be configured to force air up into tips of three middle fingers to dry faster than a thumb and pinky finger. A pinky finger and thumb deflector may be configured to force air out of the first and second glove air exhaust tubes 940*a-c*, 945*a,b* mid-way down the first and second glove air exhaust tubes 940*a-c*, 945*a,b*. For example, air outlets for a thumb and/or pinky finger may be smaller than outlets for the three middle fingers such that more air is forced into the three middle fingers. A height of the first and second glove air exhaust tubes 940*a-c*, 945*a,b* may be, for example, 8" from an air outlet 931*a-c*, 933*a,b* to tips of the fingers 943*a-c*. The air outlets 931*a-c*, 933*a,b* may include a grate 932*c* configured to prevent, for example, a finger from being inserted into the fan (or blower) 915*b,c*.

As shown in FIG. 9D, an electric circuit 900*d* for use in a garment dryer (e.g., glove dryer 100, 200*a*, 900*a-c* or garment dryer 1000, 1100, 1200, 1300, 1800*a*) may include a battery 965*d* to supply electric power to a blower 915*d* and/or a heater 920*d*. The electric circuit 900*d* may also include an on/off switch 925*d*, a fuse 939*d*, a power on light 967*d* with voltage drop resistor 966*d*, and an overvoltage protection diode 921*d*. The battery 965*d* may be, for example, configured to provide between $10V_{dc}$ and $30V_{dc}$ electric power.

Figure 10:
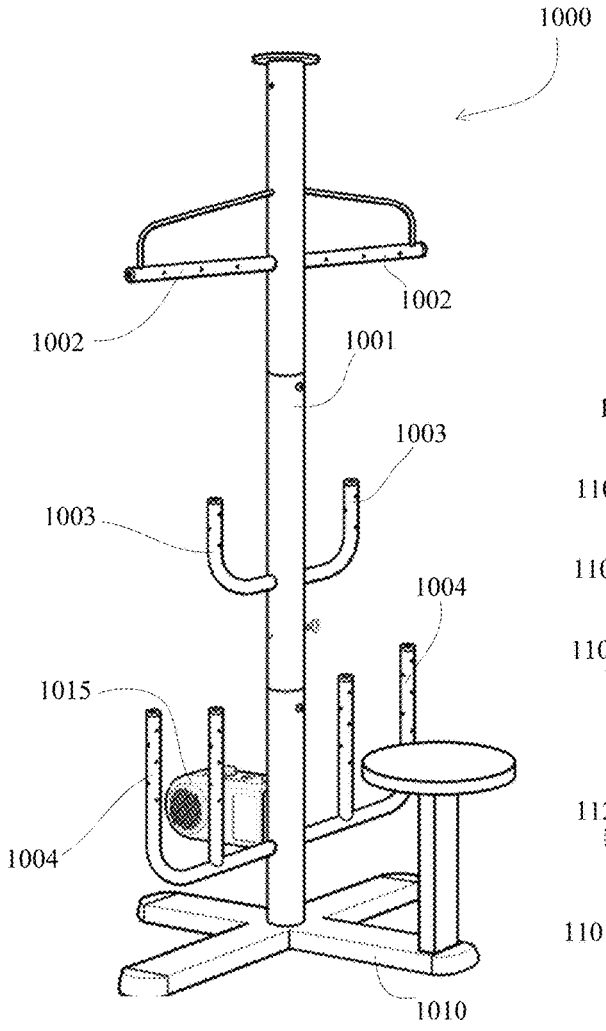
FIG. 10 depicts an example garment dryer.

Turning to FIG. 10, a garment dryer 1000 may include a main body portion 1001, a right arm portion and a left arm portion 1002, a right leg portion and a left leg portion 1004 supported on a stand 1010. The garment dryer 1000 may also include a fan 1015 along with apertures in the various portions for circulating air as described in, for example, commonly assigned U.S. Pat. No. 8,393,482 and U.S. patent application Ser. No. 15/336,730, the entire disclosures of which are incorporated herein by reference. The garment dryer 1000 may also include an enclosure as described elsewhere herein.

Figure 11:
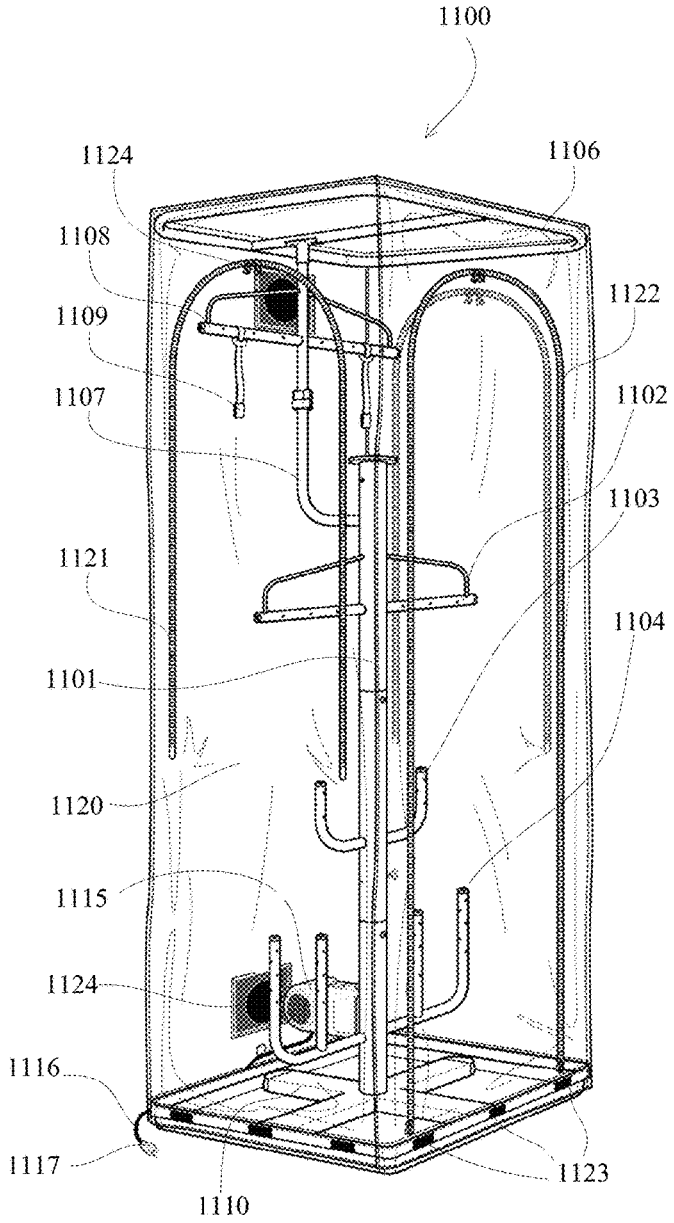
FIG. 11 depicts an example garment dryer within an example enclosure.

With reference to FIG. 11, a garment dryer 1100, generally as described above and, for example, in commonly assigned U.S. Pat. No. 8,393,482 and U.S. patent application Ser. No. 15/336,730 may include structure 1106 for supporting an enclosure 1120 for enclosing at least a substantial portion of the frame 1101 including, for example, the extensions 1107 and hanger 1102 on which clothing and/or equipment may be supported. The illustrated support structure 1106 may include a first tubular member 1107 attached to the frame (e.g., main vertical member 1101) of garment dryer 1100. Member 1107 may be releasably attached or permanently secured to the frame 1101 of the garment dryer 1100. In the illustrated embodiment, member 1106 may extend laterally (i.e., horizontally) away from member 1107, and may include a 90° bend, and a section that extends upwardly above the top of member 1101. A second tubular member may be slidably or telescopically and movably attached to member 1107, and a lockable retaining mechanism may be provided to hold member 1106 on member 1107 at a desired position to achieve height adjustability of cross members 1108 and straps 1109 relative to the frame 1101.

As shown in FIG. 11, cross members may be configured to retain a rectangular support frame 1110. Rectangular support frame 1110 can be a separate component from the enclosure, or it may be incorporated into (i.e., integrated into) the enclosure. The garment dryer 1100 may include an enclosure 1120 supported on structure 1106 and frame 1101. Enclosure 1120 may be made of an air and water impermeable material or very low permeability material, such as a light in weight, flexible, transparent plastic material. Examples of materials that may be used include transparent polyolefin films, such as polyethylene films and/or polypropylene films. The enclosure may include one or more removable or partially removable, or movable, panels, such as panels connected with other portions of the enclosure 1120 via zippers 1121, 1122 or other suitable fastening means. The enclosure 1120 may be open at the bottom, or may include a releasably attachable bottom (e.g., attached via Velcro 1123 to an associated drip pan), in which the rack 1110 is positioned over the releasable bottom of the enclosure, and secured to the remainder of the enclosure via zippers or other suitable fasteners. Alternatively, a bottom panel (e.g., drip pan) of enclosure 1120 may be integrally attached to remaining portions of the enclosure 1120, with one of the front, side or rear panels being removable or partially removable to allow rack 1110 to be positioned in enclosure 1120 on bottom panel. As another alternative, a drip pan (drip pan 1860*b-d* as shown in FIGS. 18B-D) may be positioned below rack 1110 in enclosure 1120 to collect any moisture that drips from clothing and/or equipment supported on rack 1110. The enclosure 1120 may also include air vents 1124.

The garment dryer 1100 may include a blower and/or heater 1115 including a power cord 1116 and plug 1117. The garment dryer 1100 may include a hanger 1102, shirt/coat air outlets 1103, and glove/boot/pant leg air outlets 1104.

Figure 12:
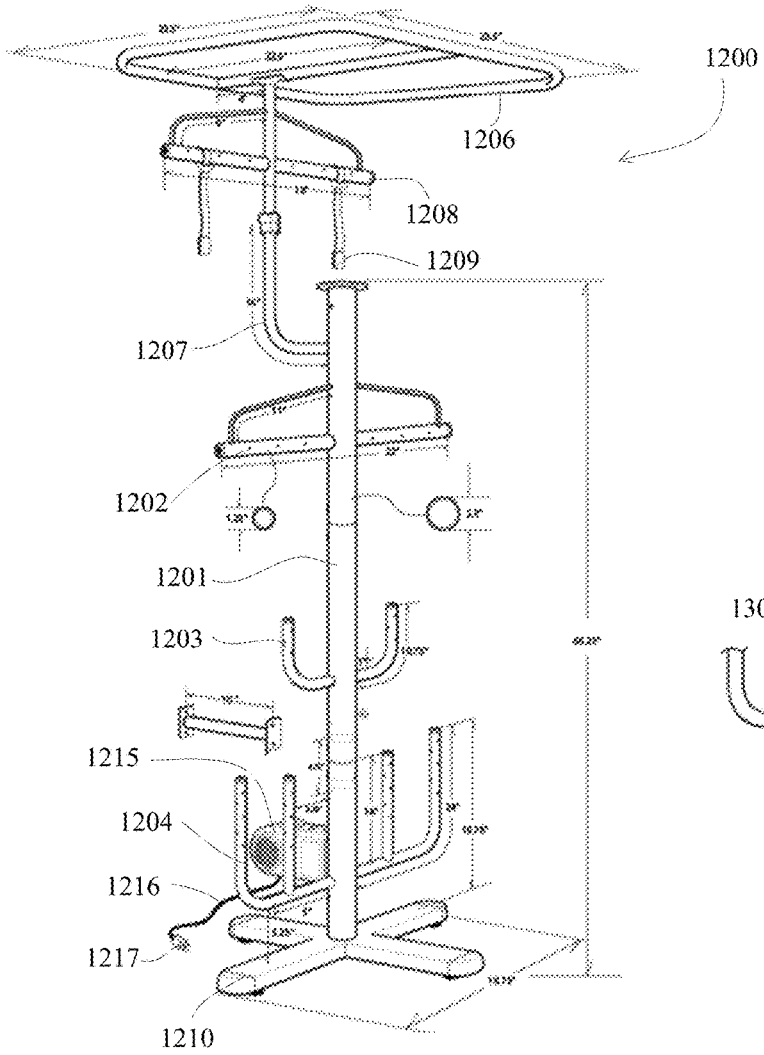
FIG. 12 depicts an example garment dryer.

Turning to FIG. 12, a garment dryer 1200, generally as described above and, for example, in commonly assigned U.S. Pat. No. 8,393,482 and U.S. patent application Ser. No. 15/336,730 may include structure 1206 for supporting an enclosure (e.g., enclosure 1120) for enclosing at least a substantial portion of the frame 1201 including, for example, cross members 1208 and straps 1209, the extensions 1207 and hanger 1202 on which clothing and/or equipment may be supported. The illustrated support structure 1206 may include a first tubular member 1207 attached to the frame (e.g., main vertical member 1201) of garment dryer 1200. Member 1207 may be releasably attached or permanently secured to the frame 1201 of the garment dryer 1200. In the illustrated embodiment, member 1206 may extend laterally (i.e., horizontally) away from member 1207, and may include a 90° bend, and a section that extends upwardly above the top of member 1201. The garment dryer 1200 may include support base 1210, a blower and/or heater 1215 including a power cord 1216 and plug 1217. The garment dryer 1200 may include a hanger 1202, shirt/coat air outlets 1203, and glove/boot/pant leg air outlets 1204.

Figure 13:
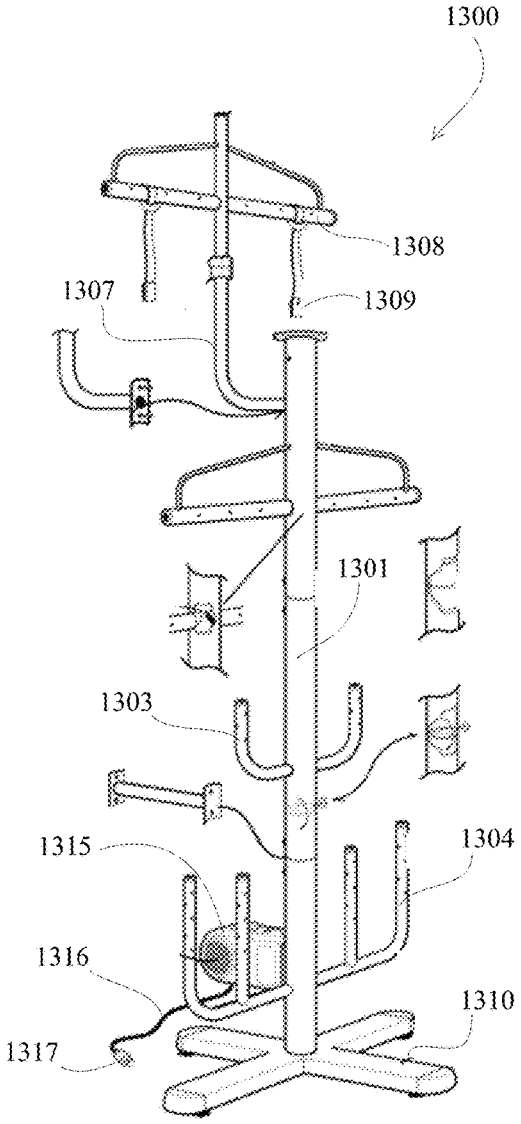
FIG. 13 depicts an example garment dryer.
Figure 14A:
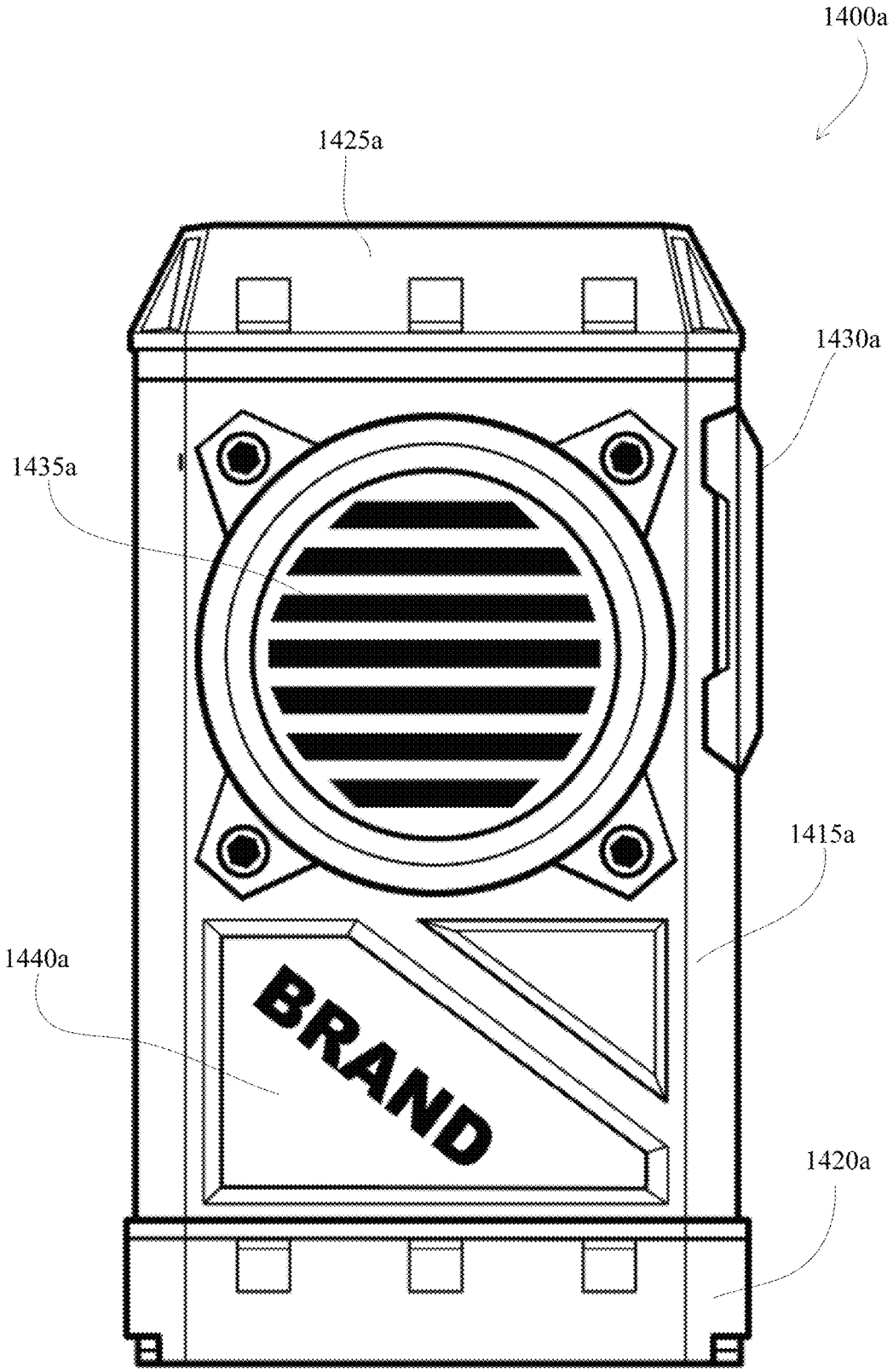
FIGS. 14A-14D depict various views of an example blower and heater for use with a glove or garment dryer.
Figure 14B:
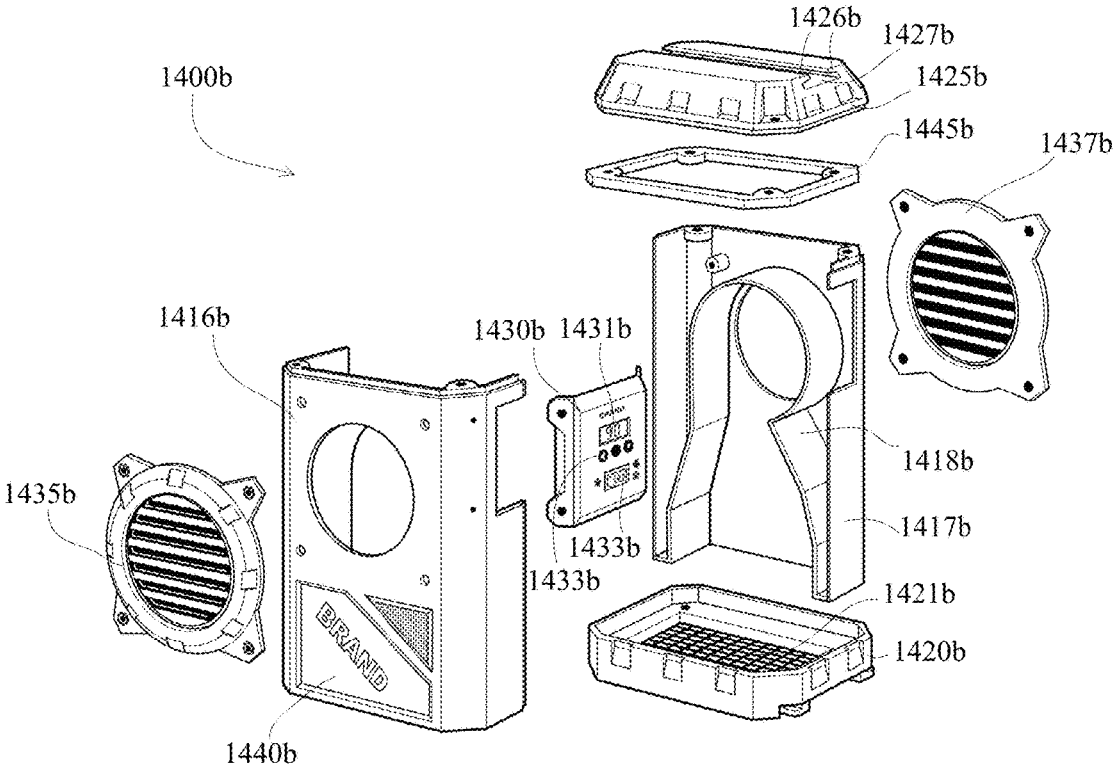
Figure 14C:
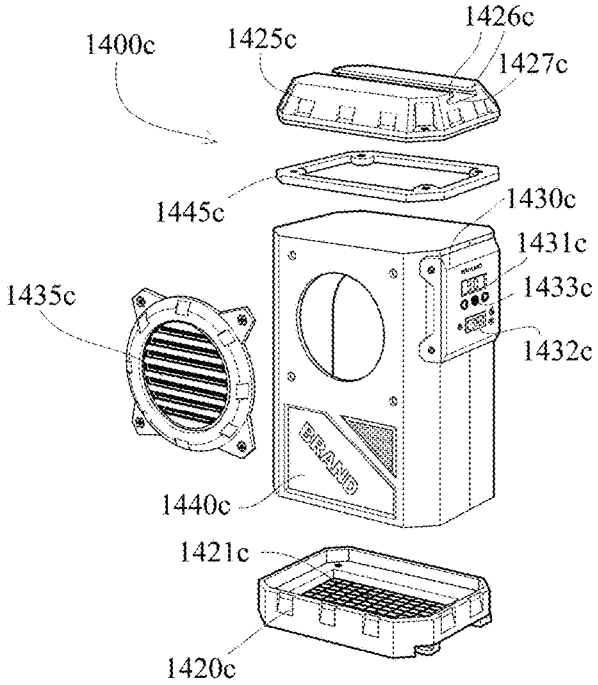
Figure 14D:
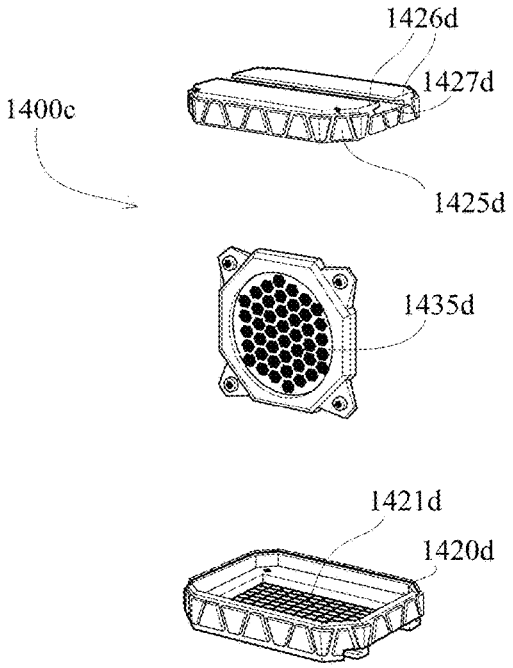

With reference to FIG. 13, a garment dryer 1300, generally as described above and, for example, in commonly assigned U.S. Pat. No. 8,393,482 and U.S. patent application Ser. No. 15/336,730 may include, for example, cross members 1308 and straps 1309, the extensions 1307 and hanger 1302 on which clothing and/or equipment may be supported. The garment dryer 1300 may include support base 1310, a blower and/or heater 1315 including a power cord 1316 and plug 1317. The garment dryer 1300 may include a hanger 1302, shirt/coat air outlets 1303, and glove/boot/pant leg air outlets 1304.

Turning to FIGS. 14A-14D, a heater and/or blower 1400*a-d* for use with a glove or garment dryer may include a body portion 1415*a* having an air inlet 1435*a-d*, a label 1440*a-c* and a control panel 1430*a-c*. The heater and/or blower 1400*a-c* may also include a bottom cover 1420*a-d* (e.g., an air inlet) and a top cover 1425*a-d* (e.g., an air outlet). The heater and/or blower 1400*a-d* may include a front housing portion 1416*b*, a rear housing portion 1417*b* having an air baffle/duct 1418*b* and a seal 1445*b,c*. The bottom cover 1420*a-d* may include an air inlet 1421*b-c*. The top cover 1425*a-d* may include, for example, a sliding engagement 1426*b-d*, 1427*b-d* to engage, for example, a garment dryer (e.g., a glove dryer) or a battery pack (e.g., battery pack 1965 of FIG. 19). While not shown in FIGS. 14A-D, a bottom cover 1420*a-d* may include a sliding engagement similar to the sliding engagement 1426*b-d*, 1427*b-d*. The control panel 1430*a-c* may include an on/off switch 1432*b,c*, a display panel 1431*b,c*, and a status indicator 1433*b,c*.

Figure 15A:
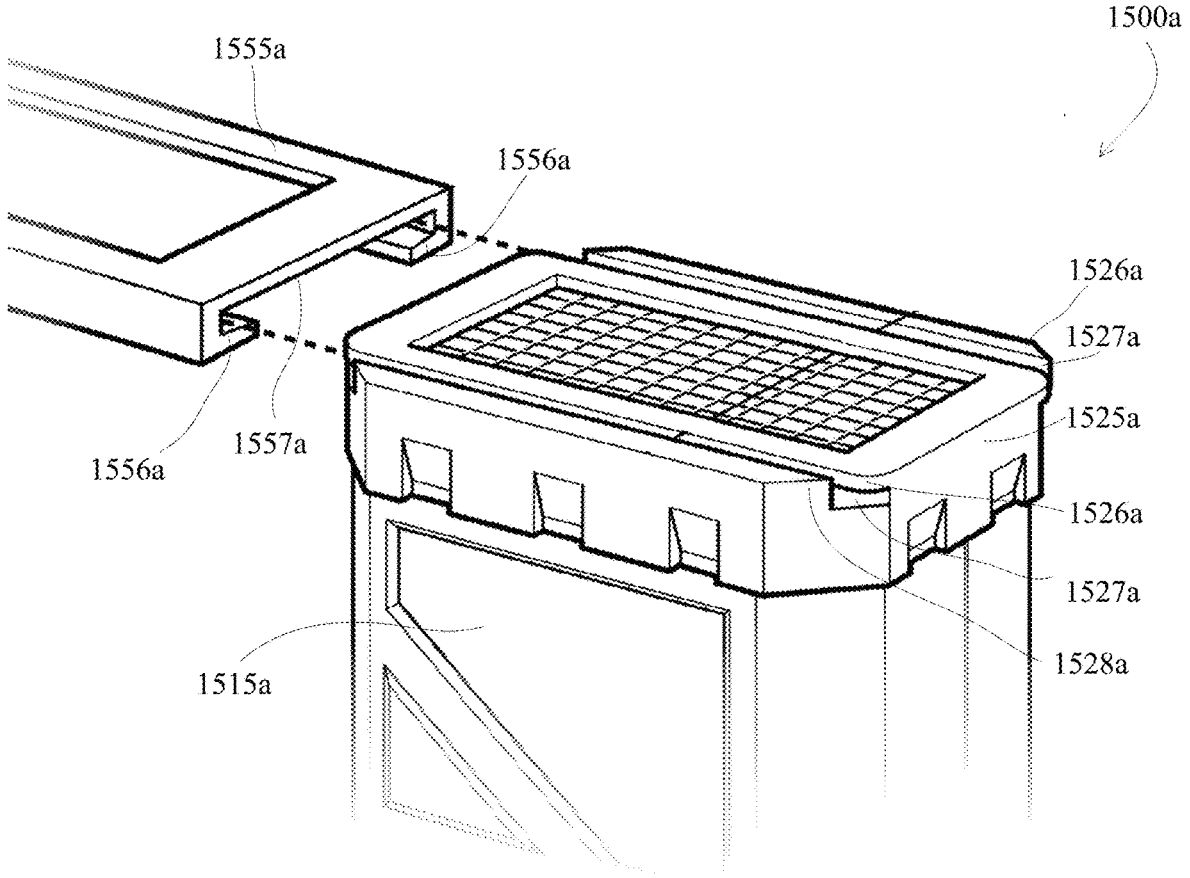
FIGS. 15A and 15B depict various views of an example sliding attachment mechanism for use within a glove or garment dryer.
Figure 15B:
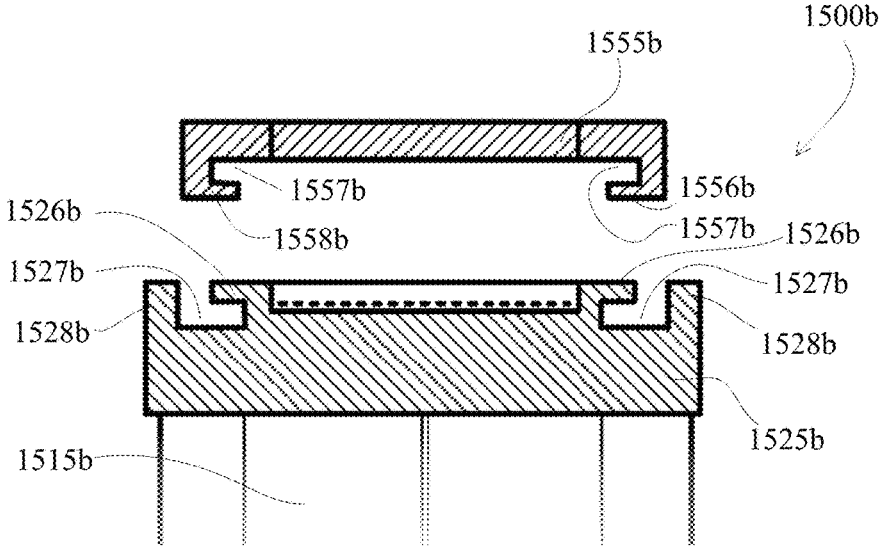

With reference to FIGS. 15A and 15B, a sliding attachment mechanism 1525*a,b*/1555*a,b* for use within a glove or garment dryer may be configured to removably couple, for example, a heater and/or blower 1515*a,b* to a glove or garment dryer. Alternatively, or additionally, the sliding attachment mechanism 1525*a,b*/1555*a,b* may be configured to removably couple, for example, a heater and/or blower 1515*a,b* to a battery pack (e.g., battery pack 1965 of FIG. 19). In any event, a sliding attachment mechanism 1525*a,b*/1555*a,b* may include first channels 1527*a,b* defined by, for example, first lips 1526*a,b* and sides 1528*a,b*, and second channels 1557*a,b* defined by, for example, second lips 1556*a,b*. The second lips 1556*a,b* may be slidably received within the first channels 1527*a,b*. A batter pack may be similar to, for example, that available from DeWalt (e.g., DCB200-2 20V MAX* Lithium Ion Battery Pack). As an alternative, or addition, the sliding attachment mechanism 1525*a,b*/1555*a,b* may be configured to removably attach a batter pack to a charger. A charger may be similar to, for example, available from DeWalt (e.g., Multiport Simultaneous Fast Charger DCB104, 140 Watt Power Inverter DXAEPI140, or 40V MAX* 6-Pack Charging Station DCB116). As an alternative to a sliding attachment mechanism 1525*a,b*/1555*a,b*, a rotatable engagement may be provided.

Figure 16:
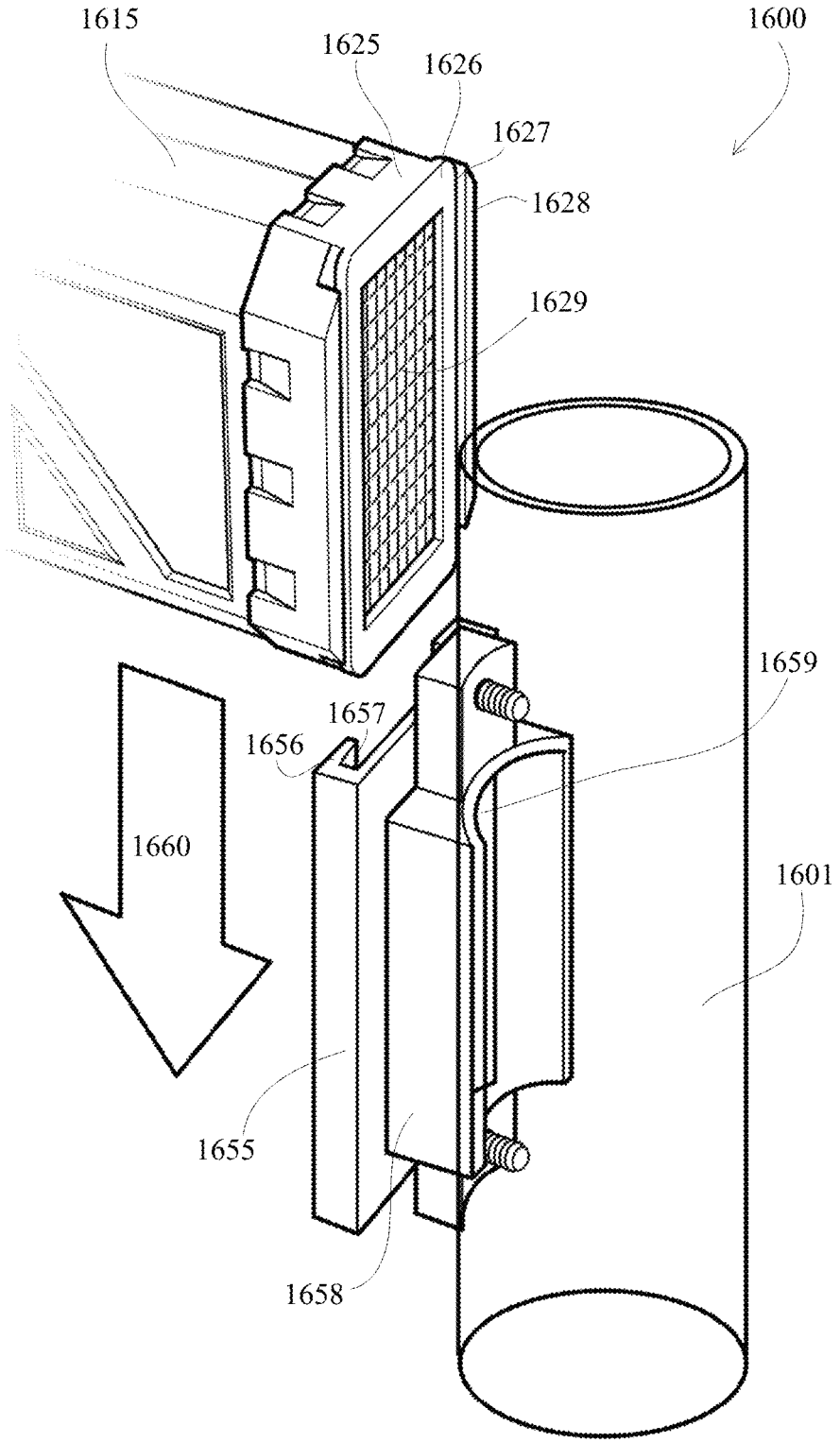
FIG. 16 depicts an example blower and heater with an example sliding attachment mechanism proximate an associated garment dryer.

Turning to FIG. 16, a blower and heater with an example sliding attachment mechanism proximate an associated garment dryer assembly 1600 may include a heater and/or blower 1615 removably engagable with a garment dryer 1601. The assembly 1600 may include a top cover 1625 having first channels 1627 defined by, for example, first lips 1626 and sides 1628, and a attachment 1655 having a mount 1658 with second channels 1657 defined by, for example, second lips 1656. The second lips 1656 may be slidably received within the first channels 1627 as shown with reference to arrow 1656. The attachment 1655 and mount 1658 may include an air aperture 1659 for conveying air received from an air outlet 1629.

Figure 17A:
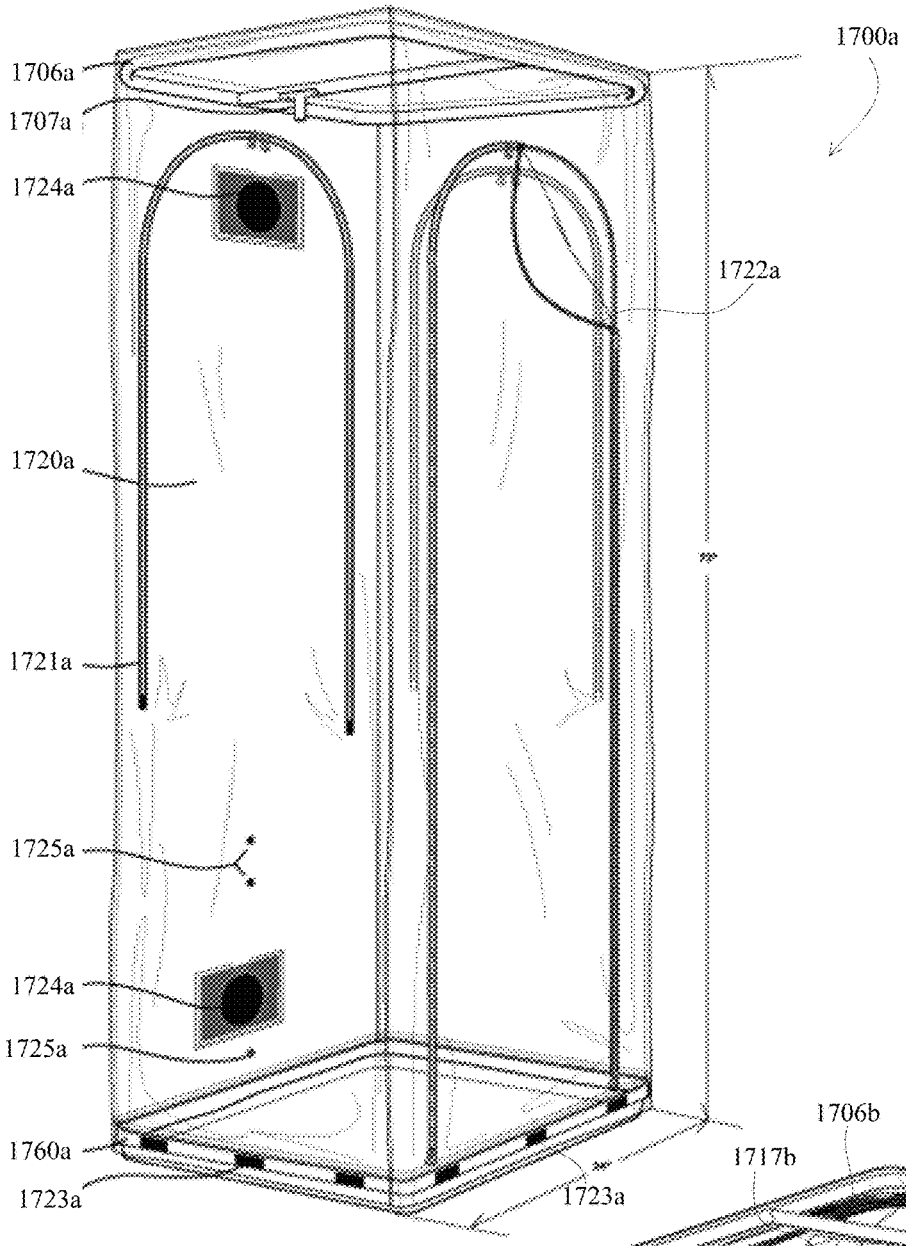
FIGS. 17A and 17B depict various views of an example enclosure for use with a glove or garment dryer.
Figure 17B:
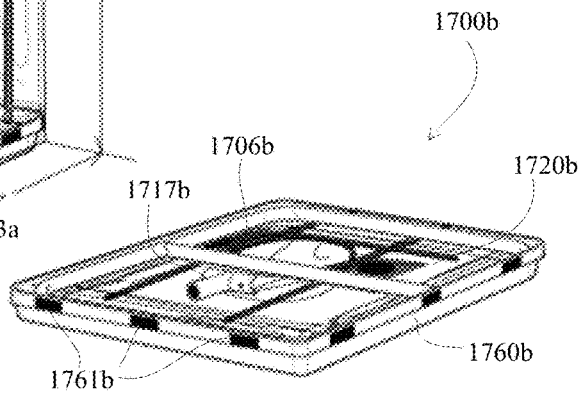

With reference to FIGS. 17A and 17B, an assembly 1700*a,b* may include an enclosure 1720*a,b* for use with a glove or garment dryer 1706*a,b*/1707*a*/1717*b*. As shown in FIG. 17B, the enclosure 1720*a,b* and the glove or garment dryer 1706*a,b*/1707*a*/1717*b* may be configured to fold up and fit, at least partially, within a drip pan 1760*a,b*. The enclosure 1720*a,b* may include first attachments (e.g., Velcro®) 1723*a* configured to engage second attachments (e.g., Velcro®) 1761*b* to secure the enclosure 1720*a,b* to the drip pan 1760*a,b*. The enclosure 1720*a,b* may include, for example, zipper openings 1721*a*, 1722*a*, air openings 1724*a*, and snaps 1725*a*. The snaps 1725*a* may be configured to engage with, for example, deodorizing filters (not shown in FIGS. 17A and 17B) to cover at least one air opening 1724*a*.

Turning to FIGS. 18A-18D, an assembly 1800*a-d* may include an enclosure 1820*a-d* for use with a glove or garment dryer 1801*a*. The enclosure 1820*a-d* may include first attachments (e.g., Velcro®) 1823*a-d* configured to engage second attachments (e.g., Velcro®) 1861*b* to secure the enclosure 1820*a-d* to the drip pan 1860*a-d*. The enclosure 1820*a-d* may include, for example, zipper openings 1821*a*, 1822*a*, air openings 1824*a*, inner flaps 1829*d*, and snaps 1825*a*. The snaps 1825*a* may be configured to engage with, for example, deodorizing filters (not shown in FIGS. 18A-D) to cover at least one air opening 1824*a*.

The garment dryer 1800*a*, generally as described above and, for example, in commonly assigned U.S. Pat. No. 8,393,482 and U.S. patent application Ser. No. 15/336,730 may include structure 1806*a* for supporting an enclosure 1820*a-d* for enclosing at least a substantial portion of the frame 1801*a* including, for example, the extensions 1807*a* and hanger 1802*a* on which clothing and/or equipment may be supported. The illustrated support structure 1806*a* may include a first tubular member 1807*a* attached to the frame (e.g., main vertical member 1801*a*) of garment dryer 1801*a*. Member 1807*a* may be releasably attached or permanently secured to the frame 1801*a* of the garment dryer 1801*a*. In the illustrated embodiment, member 1806*a* may extend laterally (i.e., horizontally) away from member 1807*a*, and may include a 90° bend, and a section that extends upwardly above the top of member 1801*a*. A second tubular member may be slidably or telescopically and movably attached to member 1807*a*, and a lockable retaining mechanism may be provided to hold member 1806*a* on member 1807*a* at a desired position to achieve height adjustability of cross members 1108*a* and straps 1809*a* relative to the frame 1801*a*.

Figure 18A:
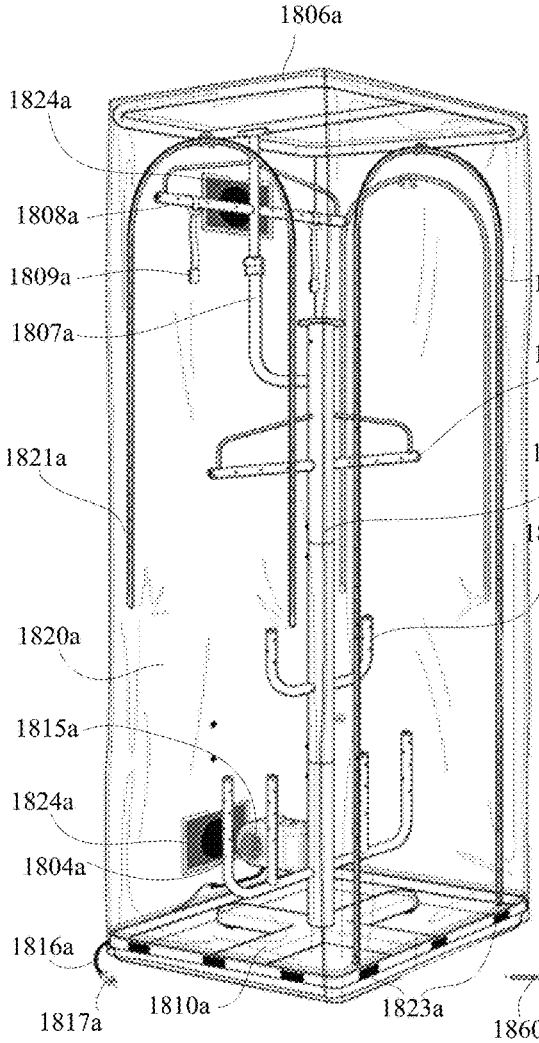
FIGS. 18A-18D depict various views of an example garment dryer with an example enclosure.
Figure 18B:
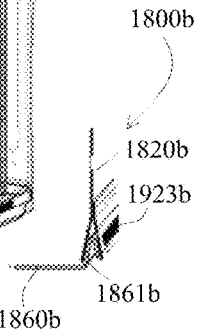
Figure 18C:
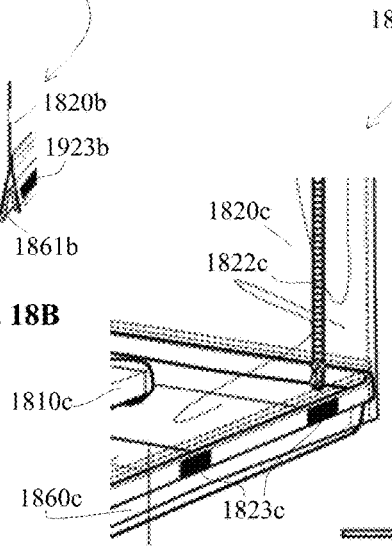
Figure 18D:
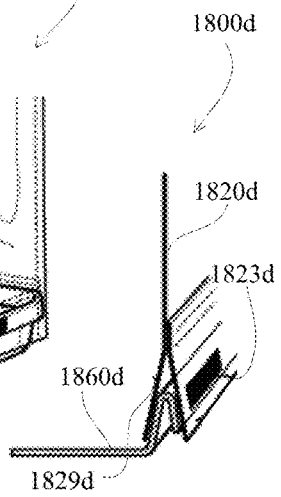

As shown in FIG. 18A, cross members may be configured to retain a rectangular support frame 1810*a,c*. Rectangular support frame 1810*a,c* can be a separate component from the enclosure, or it may be incorporated into (i.e., integrated into) the enclosure. The garment dryer 1801*a* may include an enclosure 1820*a-d* supported on structure 1806*a* and frame 1801*a*. Enclosure 1820*a-d* may be made of an air and water impermeable material or very low permeability material, such as a light in weight, flexible, transparent plastic material. Examples of materials that may be used include transparent polyolefin films, such as polyethylene films and/or polypropylene films. The enclosure may include one or more removable or partially removable, or movable, panels, such as panels connected with other portions of the enclosure 1820*a-d* via zippers 1821*a*, 1822*a* or other suitable fastening means. The enclosure 1820*a-d* may be open at the bottom, or may include a releasably attachable bottom (e.g., attached via Velcro 1823*a-d* to an associated drip pan), in which the rack 1810*a,c* is positioned over the releasable bottom of the enclosure, and secured to the remainder of the enclosure via zippers or other suitable fasteners. Alternatively, a bottom panel (e.g., drip pan) of enclosure 1820*a-d* may be integrally attached to remaining portions of the enclosure 1820*a-d*, with one of the front, side or rear panels being removable or partially removable to allow rack 1810*a,c* to be positioned in enclosure 1820*a-d* on bottom panel. As another alternative, a drip pan 1860*b-d* may be positioned below rack 1810*a-d* in enclosure 1820*a-d* to collect any moisture that drips from clothing and/or equipment supported on rack 1810*a*. The enclosure 1820*a-d* may also include air vents 1824*a*.

The garment dryer 1800*a-d* may include a blower and/or heater 1815*a* including a power cord 1816*a* and plug 1817*a*. The garment dryer 1800*a-d* may include a hanger 1802*a*, shirt/coat air outlets 1803*a*, and glove/boot/pant leg air outlets 1804*a*.

Figure 19:
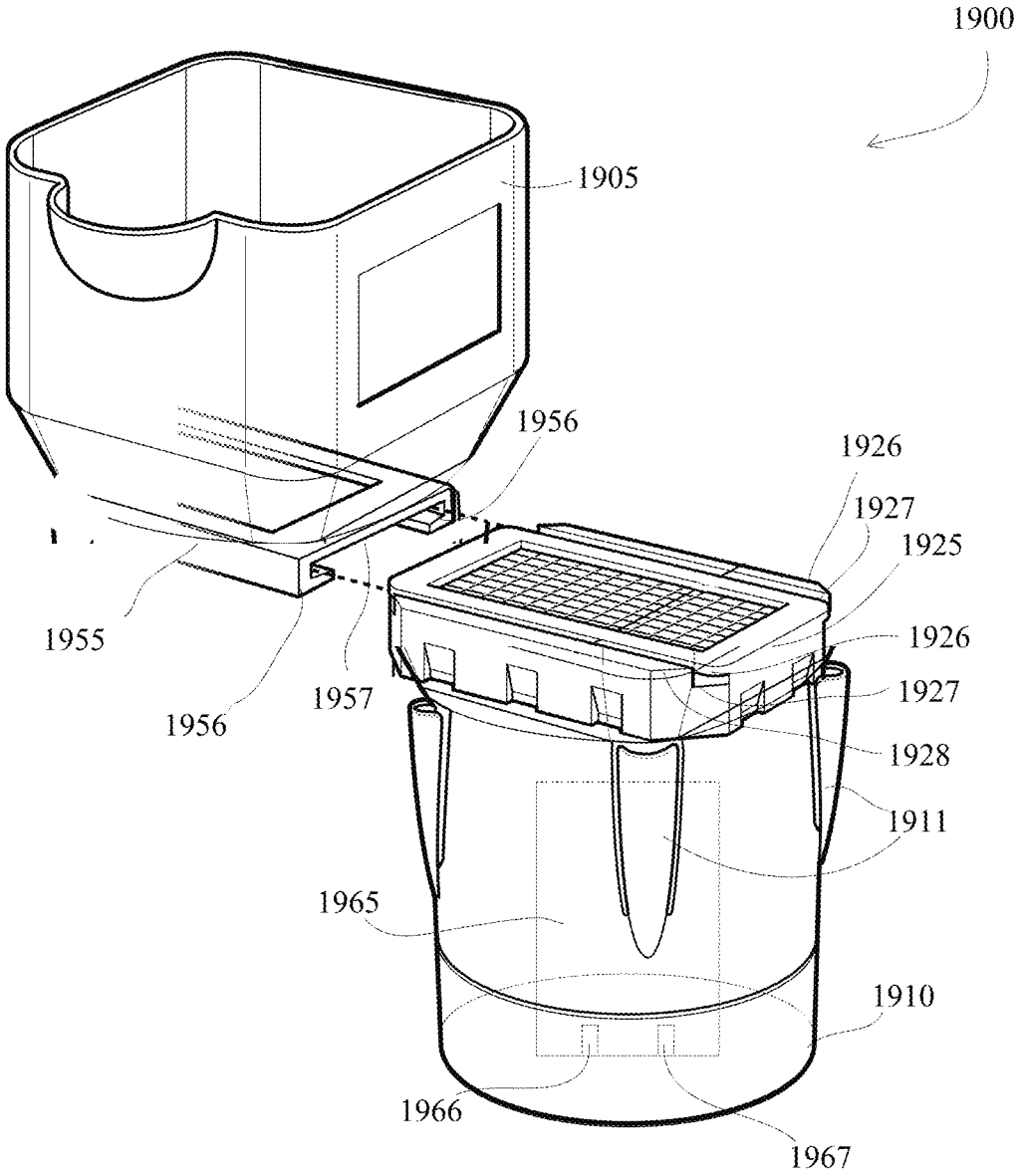
FIG. 19 depicts various views of an example sliding attachment mechanism for use within a glove or garment dryer.

With reference to FIG. 19, a sliding attachment mechanism 1925/1955 for use within a glove or garment dryer may be configured to removably couple, for example, a battery pack 1910 to a glove or garment dryer 1905. Alternatively, or additionally, the sliding attachment mechanism 1925/1955 may be configured to removably couple, for example, the battery pack 1910 to a charger (e.g., docking station 705 of FIG. 7). In any event, a sliding attachment mechanism 1925/1955 may include first channels 1927 defined by, for example, first lips 1926 and sides 1928, and second channels 1957 defined by, for example, second lips 1956. The second lips 1956 may be slidably received within the first channels 1927. A batter pack may be similar to, for example, that available from DeWalt (e.g., DCB200-2 20V MAX* Lithium Ion Battery Pack). As an alternative, or addition, the sliding attachment mechanism 1925/1955 may be configured to removably attach a batter pack to a charger. A charger may be similar to, for example, available from DeWalt (e.g., Multiport Simultaneous Fast Charger DCB104, 140 Watt Power Inverter DXAEPI140, or 40V MAX* 6-Pack Charging Station DCB116). As an alternative to a sliding attachment mechanism 1925/1955, a rotatable engagement may be provided. The battery pack 1910 may be configured to fit within a standard vehicle cup holder and may have cup holder securing features 1911. The battery pack 1910 may include one or more batteries 1965 having electrical contacts 1966, 1967 configured to attach the battery 1965 to a blower and/or heater and/or to a charger (i.e., the electrical contacts 1966, 1967 may be arranged within the sliding attachment mechanism 1925/1955).

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A glove dryer, comprising;

a body having a base defining a substantially round shaped cross section, wherein the substantially round shaped base is configured to be received within a standard vehicle cup holder, and wherein the body includes a plurality of air intake vents that share a same axis with the substantially round shaped base;

an electric blower;

an electric heater element, wherein the electric blower is configured to draw air in the plurality of air intake vents and blow the air toward the electric heater element; and a wind tunnel having bleed air vents configured to circulate air flow from the electric blower around the electric heater element.

2. A glove dryer as in claim 1, further comprising:

at least one internal battery located within the substantially round shaped base, wherein the substantially round shaped base includes electrical contacts that protrude to an exterior of the substantially round shaped base.

3. The glove dryer as in claim 1, further comprising:

at least one glove air exhaust tube having a pinky finger air outlet and a thumb air outlet.

4. The glove dryer as in claim 1, further comprising:

at least one glove air exhaust tube, wherein the at least one glove air exhaust tube includes a pinky finger air outlet, a pinky finger air outlet deflector, three finger shaped supports, a thumb air outlet, and a thumb air outlet deflector.

5. The glove dryer as in claim 1, further comprising:

a controller configured to automatically vary at least one of: an air temperature, or an air flow rate, by controlling the electric blower independent from the electric heating element.

6. The glove dryer as in claim 1, further comprising:

a controller configured to automatically control at least one of: an air temperature, or an air flow rate, based on a moisture input, by controlling the electric blower independent from the electric heating element.

7. The glove dryer as in claim 1, further comprising:

a continuously variable user control configured to enable a user to set at least one of: an air temperature, an air flow rate, or a glove moisture, wherein the continuously variable user control includes an increase button and a decrease button.

8. A glove dryer, comprising;

a body having a base defining a substantially round shaped cross section, wherein the substantially round shaped base is configured to be received within a base of a docking station, and wherein the body includes a plurality of air intake vents that share a same axis with the substantially round shaped base;

an electric heater element;

an electric blower configured to draw air in through the plurality of air intake vents, through the electric heater element, and blow the air toward at least one air outlet;

a wind tunnel having bleed air vents configured to circulate air flow from the electric blower around the electric heater element; and a controller configured such that a user is able to continuously vary the electric heater element independent of the electric blower.

9. The glove dryer as in claim 8, further comprising:

at least one glove air exhaust tube having a pinky finger air outlet and a thumb air outlet.

10. The glove dryer as in claim 8, further comprising:

at least one glove air exhaust tube, wherein the at least one glove air exhaust tube includes a pinky finger air outlet, a pinky finger air outlet deflector, three finger shaped supports, a thumb air outlet, and a thumb air outlet deflector.

11. The glove dryer as in claim 8, further comprising:

a controller configured to automatically vary an air temperature independent from an air flow rate.

12. The glove dryer as in claim 8, further comprising:

a controller configured to automatically control an air temperature independent of an air flow rate, based on a moisture input.

13. The glove dryer as in claim 8, further comprising:

a user control configured to enable a user to independently set an air temperature, an air flow rate, and a glove moisture.

14. A glove dryer, comprising;

a body having a base defining a substantially round shaped cross section, wherein the substantially round shaped base is configured to be received within a vehicle mounting apparatus, wherein the vehicle mounting apparatus is selected from the group including at least one of: a vehicle cup holder, or a docking station, and wherein the body includes a plurality of air intake vents that share a same axis with the substantially round shaped base;

an electric heater element;

an electric blower configured to draw air in through the plurality of air intake vents, and blow air through the electric heater element;

a wind tunnel having bleed air vents configured to circulate air flow from the electric blower around the electric heater element; and a controller configured such that a user is able to control the electric heater element independent of the electric blower.

15. The glove dryer as in claim 14, further comprising:

at least one internal battery and a battery charger located within the substantially round shaped base, wherein the substantially round shaped base includes electrical contacts that protrude to an exterior of the substantially round shaped base.

16. The glove dryer as in claim 14, further comprising:

at least one glove air exhaust tube having a pinky finger air outlet and a thumb air outlet.

17. The glove dryer as in claim 14, further comprising:

at least one glove air exhaust tube, wherein the at least one glove air exhaust tube includes a pinky finger air outlet, a pinky finger air outlet deflector, three finger shaped supports, a thumb air outlet, and a thumb air outlet deflector.

18. The glove dryer as in claim 14, further comprising:

a controller configured to automatically vary an air temperature and an air flow rate, independent of one another, via a user control.

19. The glove dryer as in claim 14, further comprising:

a controller configured to automatically control an air temperature independent of an air flow rate, based on a moisture input.

20. The glove dryer as in claim 14, further comprising:

a user control configured to enable a user to independently set an air temperature, an air flow rate, and a glove moisture.

* * * * *